US011672053B2

(12) United States Patent
Jeong

(10) Patent No.: US 11,672,053 B2
(45) Date of Patent: Jun. 6, 2023

(54) INDUCTION HEATING DEVICE AND VESSEL-SENSING METHOD OF THE INDUCTION HEATING DEVICE

(71) Applicant: LG ELECTRONICS INC., Seoul (KR)

(72) Inventor: Shinjae Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 496 days.

(21) Appl. No.: 16/684,804

(22) Filed: Nov. 15, 2019

(65) Prior Publication Data

US 2020/0163169 A1 May 21, 2020

(30) Foreign Application Priority Data

Nov. 19, 2018 (KR) ..... 10-2018-0143011

(51) Int. Cl.
*H05B 6/06* (2006.01)
*H05B 6/12* (2006.01)

(52) U.S. Cl.
CPC ..... *H05B 6/062* (2013.01); *H05B 6/1272* (2013.01); *H05B 2213/05* (2013.01)

(58) Field of Classification Search
CPC ... H05B 2213/05; H05B 6/1272; H05B 6/062
See application file for complete search history.

(56) References Cited

U.S. PATENT DOCUMENTS 4,013,859 A * 3/1977 Peters, Jr. ..... H05B 6/062 219/626
2007/0125768 A1 6/2007 Kim et al.
2018/0110364 A1* 4/2018 Nam ..... H05B 6/44
2018/0168005 A1* 6/2018 Yun ..... H05B 6/065
2019/0335547 A1 10/2019 Yoon
2020/0022228 A1 1/2020 Heo

FOREIGN PATENT DOCUMENTS

| | | |
|---|---|---|
| EP | 1 793 653 | 6/2007 |
| KR | 10-2006-0081743 | 7/2006 |
| KR | 10-2016-0139380 | 12/2016 |
| KR | 10-2018-0091542 | 8/2018 |
| WO | WO 2018/093073 | 5/2018 |
| WO | WO 2018/106013 | 6/2018 |

OTHER PUBLICATIONS

Korean Office Action dated Jan. 17, 2020 issued in KR Application No. 10-2018-0143011.
European Search Report dated Apr. 17, 2020 issued in EP Application No. 19209462.1.

* cited by examiner

*Primary Examiner* — Dana Ross
*Assistant Examiner* — Kuangyue Chen
(74) *Attorney, Agent, or Firm* — Ked & Associates, LLP

(57) ABSTRACT

Disclosed are an induction heating device and a vessel sensing method of the induction heating device. The induction heating device determines whether a vessel is present in a heating region corresponding to a working coil using two sensing methods. In more detail, the induction heating device determines whether a vessel is present in the heating region by sequentially performing first vessel sensing based on a resonance current value of the working coil and second vessel sensing based on a sensing value obtained by a vessel sensor. It is possible to precisely sense a vessel by applying the two sensing methods as described above.

20 Claims, 20 Drawing Sheets

INDUCTION HEATING DEVICE AND VESSEL-SENSING METHOD OF THE INDUCTION HEATING DEVICE

CROSS-REFERENCE TO RELATED APPLICATION(S)

This application claims priority to and the benefit of Korean Patent Application No. 10-2018-0143011, filed in Korea on Nov. 19, 2018, the disclosure of which is incorporated herein by reference in its entirety.

BACKGROUND

1. Field

The present disclosure relates to an induction heating device and a vessel sensing method of the induction heating device.

2. Background

At home and in restaurants, a variety of types of cooking utensils for heating food are in use. Conventionally, gas stoves using gas as a fuel have been widely supplied and used. Recently, devices heating a cooking vessel such as a pot using electric power without using gas have been supplied.

A method of heating a vessel using electric power is roughly divided into a resistance heating method and an induction heating method. The resistance heating method is a method of heating a vessel by transferring heat generated when currents are applied to a metallic resistance wire or a nonmetallic heating element, such as silicon carbide, to a vessel through emission or conduction. Also, the induction heating method is a method of heating a vessel autonomously by generating an eddy current in a vessel having a magnetic property using a magnetic field generated near a working coil when high frequency power at a certain level is applied to the working coil.

A principle of the induction heating method will be described in detail as follows. First, as power is applied to an induction heating device, currents at a certain level are applied to a working coil. Accordingly, a resonance current flows through the working coil disposed in the induction heating device such that an induction magnetic field is generated near the working coil. When lines of magnetic force of the generated induction magnetic field pass through a bottom surface of a vessel placed above the working coil, eddy currents are generated at the bottom surface of the vessel. The vessel is heated by the generated eddy currents.

Types of vessels which are usable on the induction heating device are restricted. This is because it is possible to heat a vessel only when eddy currents are formed in the vessel by a magnetic field formed by a working coil as described above. However, it is difficult for a user to determine whether a corresponding vessel is a vessel usable in an induction heating device only through an exterior of the vessel. Also, when a user tries to cook using a vessel unusable in an induction heating device, power of the induction heating device is unnecessarily consumed and there is a high possibility that a failure occurs in the induction heating device.

Accordingly, methods for determining whether a usable vessel is present on an induction heating device are provided. For example, Korean Patent Publication No. 10-2006-0081743 describes a method of receiving a driving signal output from an inverter as feedback when a high frequency voltage is applied to a working coil and determining whether a vessel is not present or whether a vessel is a small vessel on the basis of a waveform or level of the driving signal.

However, according to the related art, since the working coil for sensing a vessel is driven using high voltage and high power, there are problems in that great noise occurs and a lot of power is consumed when the vessel is sensed. Also, when the vessel is sensed using the working coil like the related art, since noise occurs in the driving signal as a temperature of the vessel increases, it is difficult to precisely sense the vessel.

The above reference is incorporated by reference herein where appropriate for appropriate teachings of additional or alternative details, features and/or technical background.

BRIEF DESCRIPTION OF THE DRAWINGS

Embodiments will be described in detail with reference to the following drawings in which like reference numerals refer to like elements, and wherein.

DETAILED DESCRIPTION

Figure 1:
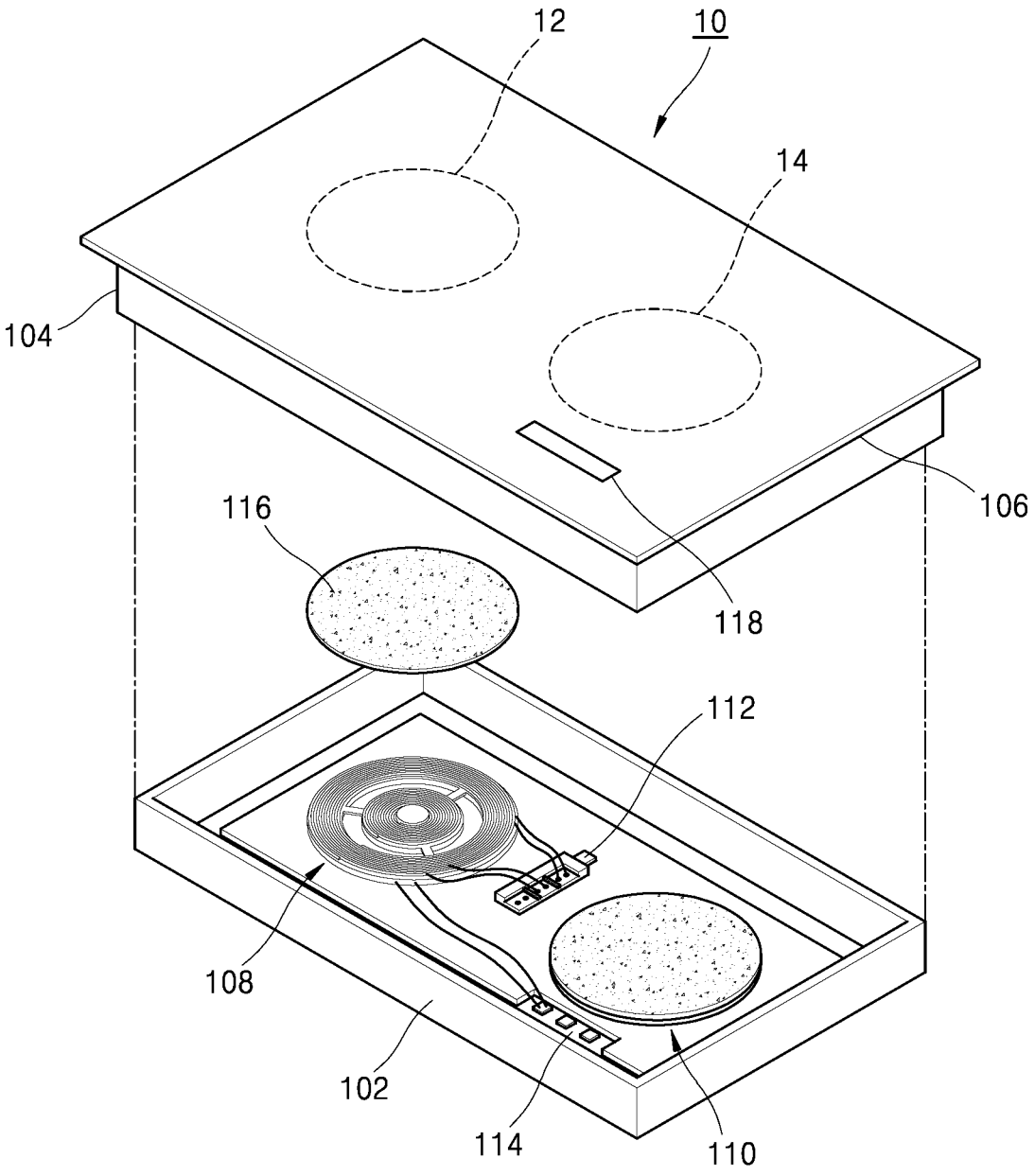
FIG. 1 is a configuration diagram of an induction heating device according to one embodiment of the present disclosure.

The above-described objects, features, and advantages will be described in detail with reference to the attached drawings such that one of ordinary skill in the art may easily execute the technical concept of the present disclosure. In a description of embodiments of the present disclosure, a detailed description of a well-known technology of the related art will be omitted when it is deemed to obscure the essence of the present disclosure. Hereinafter, exemplary embodiments of the present disclosure will be described in detail with reference to the attached drawings. Throughout the drawings, like reference numerals refer to the same or similar elements.

FIG. 1 is a configuration diagram of an induction heating device according to one embodiment of the present disclosure. Referring to FIG. 1, an induction heating device 10 according to one embodiment of the present disclosure includes a case 102 which forms a main body and a cover plate 104 coupled with the case 102 to seal the case 102.

The cover plate 104 is coupled with a top surface of the case 102 and seals a space formed in the case 102 from the outside. The cover plate 104 includes an upper panel 106 on which a vessel for cooking food is placeable. In one embodiment of the present disclosure, the upper panel 106 may be formed of a tempered glass material such as ceramic glass.

Heating regions 12 and 14 are formed on the upper panel 106 at positions corresponding to working coil assemblies 108 and 110, respectively. To allow a user to clearly recognize positions of the heating regions 12 and 14, lines or figures corresponding to the heating regions 12 and 14 may be displayed on the upper panel 106.

Referring back to FIG. 1, the working coil assemblies 108 and 110 for heating vessels are disposed in the space formed in the case 102. Also, an interface module 114, which has a function of allowing to the user to apply power or adjusting outputs of the working coil assemblies 108 and 110 and has a function displaying information related to the induction heating device 10, is provided inside the case 102. The interface module 114 may be formed as a touch panel to which information is inputtable using touch and simultaneously displaying information. However, according to an embodiment, the interface module 114 may have a different structure.

Also, a manipulation region 118 disposed at a position corresponding to the interface module 114 is provided on the upper panel 106. For user's manipulation, letters, images, or the like may be printed in the manipulation region 118 in advance. The user may perform a desired manipulation by touching a particular spot of the manipulation region 118 referring to the previously printed letters or images. The interface module 114 may sense a touch operation for the manipulation region 118 and transfer a signal to a controller (not shown). Also, information such as numbers, letters, or the like output through the interface module 114 may be displayed through the manipulation region 118.

Also, a power supply 112 configured to supply power to the working coil assemblies 108 and 110 or the interface module 114 is disposed in the space formed in the case 102. For reference, although an example is illustrated in which two working coil assemblies 108 and 110 are in the case 102 in the embodiment of FIG. 1, one working assembly or two or more working coil assemblies may be disposed in the case 102 according to an embodiment.

The working coil assemblies 108 and 110 each include an insulating sheet 116 configured to protect coils from heat generated by working coils forming an induced magnetic field using high frequency alternating currents supplied by the power supply 112 and the vessel. Depending on an embodiment, the insulating sheet 116 may be omitted.

Also, although not shown in FIG. 1, the controller may be disposed in the space formed in the case 102. The controller receives a user's command (for example, a heating command) through the manipulation region 118 and the interface module 114 and controls power supply to the working coils by controlling the power supply 112 according to the user's command.

Figure 2:
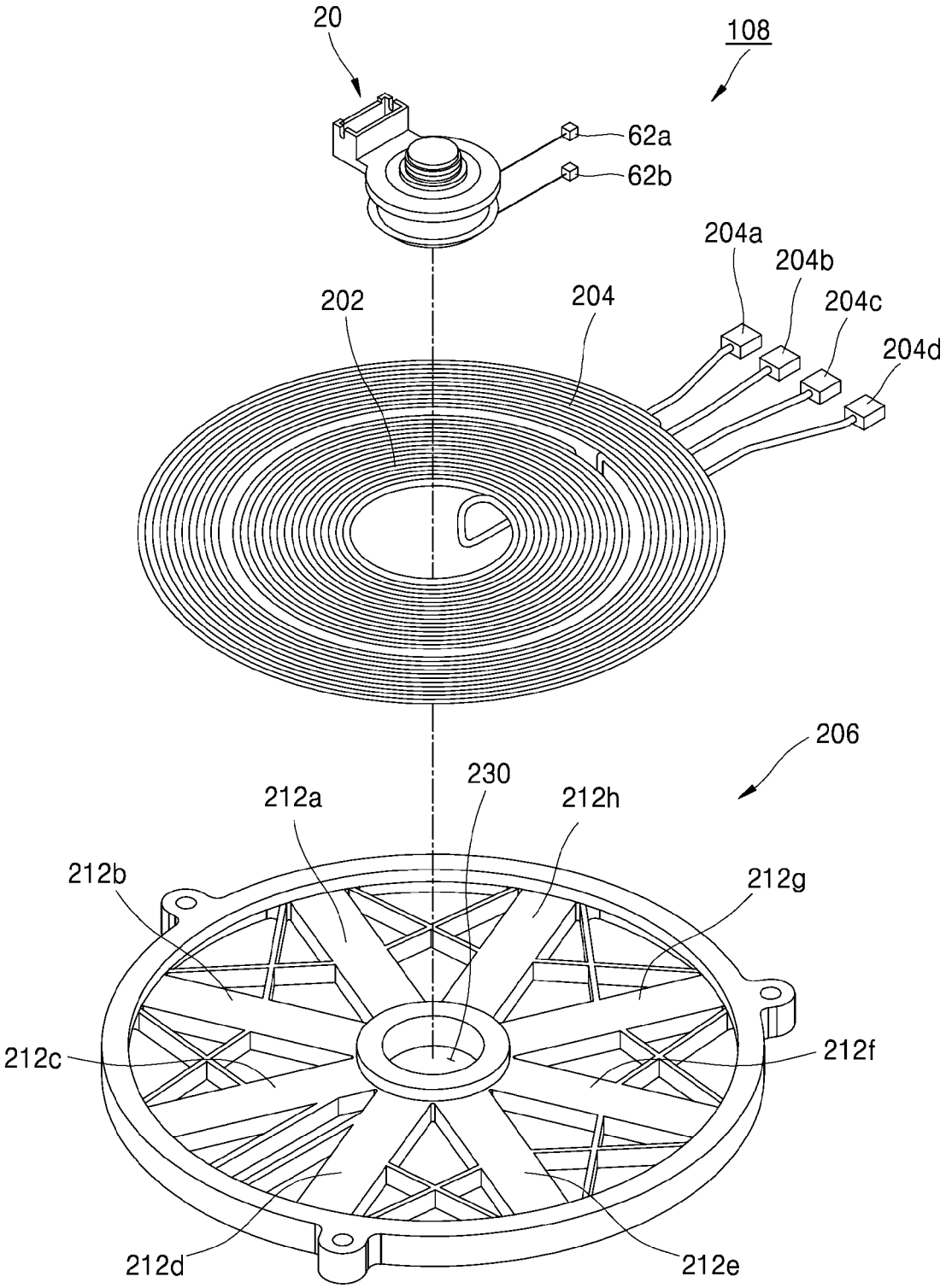
FIG. 2 is a perspective view illustrating a structure of a working coil assembly included in the induction heating device according to one embodiment of the present disclosure.
Figure 3:
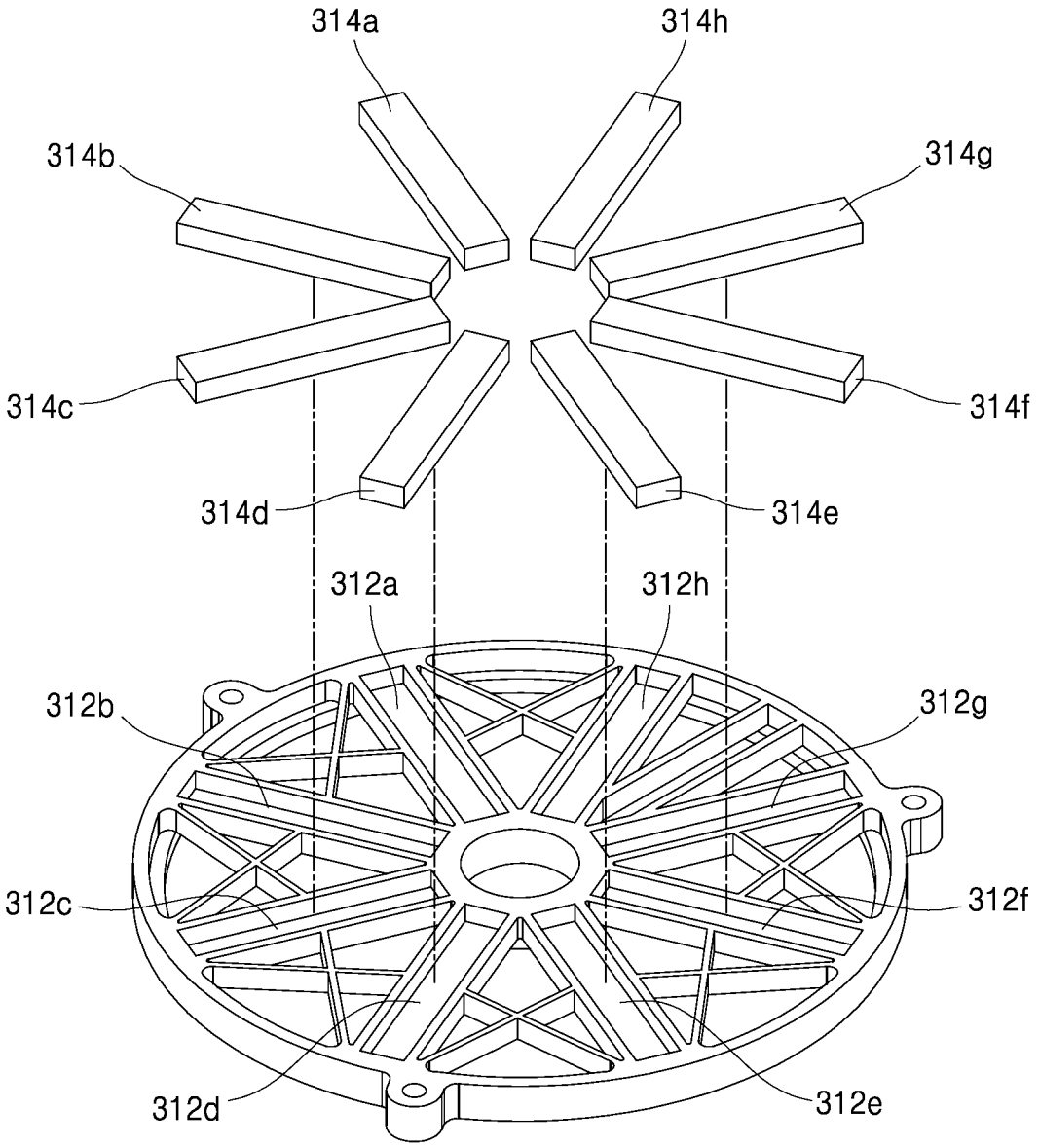
FIG. 3 is a perspective view illustrating a bottom of a coil base included in the working coil assembly according to one embodiment of the present disclosure.

FIG. 2 is a perspective view illustrating a structure of the working coil assembly included in the induction heating device according to one embodiment of the present disclosure. Also, FIG. 3 is a perspective view illustrating a bottom of a coil base included in the working coil assembly according to one embodiment of the present disclosure. Referring to the drawings, the working coil assembly 108 according to one embodiment of the present disclosure includes a first working coil 202, a second working coil 204, and a coil base 206. For reference, although an embodiment in which two working coils, that is, the first working coil 202 and the second working coil 204, are disposed on the coil base 206 is shown in FIGS. 2 and 3, depending on an embodiment, one working coil or three or more working coils may be disposed on the coil base 206.

The first working coil 202 is mounted on a top of the coil base 206 and is wound by a first number of rotations in a radial direction. Also, the second working coil 204 is mounted on the top of the coil base 206 and is wound by a second number of rotations in the radial direction while sharing a center with the first working coil 202.

A number of rotations of the first working coil 202 and a number of rotations of the second working coil 204 may vary according to an embodiment. A sum of the number of rotations of the first working coil 202 and the number of rotations of the second working coil 204 may be restricted according to a size and induced heating of the coil base 206 and specifications of a wireless power transmission device.

Both ends of the first working coil 202 and both ends of the second working coil 204 extend outward from both ends of the first working coil 202 and the second working coil 204. Connectors 204*a* and 204*b* are connected to both ends of the first working coil 202, and connectors 204*c* and 204*d* are connected to both ends of the second working coil 204. The first working coil 202 and the second working coil 204 may be electrically connected to the controller or the power supply through the connectors 204*a*, 204*b*, 204*c*, and 204*d*. According to an embodiment, the connectors 204*a*, 204*b*, 204*c*, and 204*d* may be embodied as conductive connection terminals.

The coil base 206 is a structure configured to accommodate the first working coil 202 and the second working coil 204 and is formed of a nonconductive material. Accommodation holes 212*a* to 212*h* configured to accommodate a magnetic sheet, for example, a ferrite sheet which will be described below, are formed at a bottom end of a region in which the first working coil 202 and the second working coil 204 are mounted.

As shown in FIG. 3, accommodation holes 312*a* to 312*h* configured to accommodate ferrite sheets 314*a* to 314*h* are formed below the coil base. The ferrite sheets are arranged in a radial direction of the first working coil 202 and the second working coil 204. For reference, the number, shape, position, sectional region, and the like of the ferrite sheets may vary according to an embodiment.

As shown in FIGS. 2 and 3, the first working coil 202 and the second working coil 204 are mounted above the coil base, and the magnetic sheets are mounted below the first working coil 202 and the second working coil 204. The magnetic sheets may shield magnetic fluxes generated by the first working coil 202 and the second working coil 204 from flowing toward a bottom of the coil base 206 and may increase density of the magnetic fluxes generated by the first working coil 202 and the second working coil 204.

Meanwhile, as shown in FIG. 2, the vessel detecting sensor 20 according to one embodiment of the present disclosure may be disposed in a central region of the first working coil 202. In the embodiment of FIG. 2, the vessel detecting sensor 20 may be disposed to share the center with the first working coil 202. However, a position of the vessel detecting sensor 220 may vary according to an embodiment.

A sensing coil is wound on an outer surface of a body inserted into the vessel detecting sensor 20 according to a predetermined number of rotations. Connectors 62*a* and 62*b* are connected to both ends of the sensing coil. The sensing coil may be electrically connected to the controller or the power supply through the connectors 62*a* and 62*b*. The controller may supply currents to the sensing coil through the connectors 62*a* and 62*b* of the vessel detecting sensor 20 and determine whether a vessel is present in the heating region on the basis of a resonance signal generated by supplying of the currents.

Figure 4:
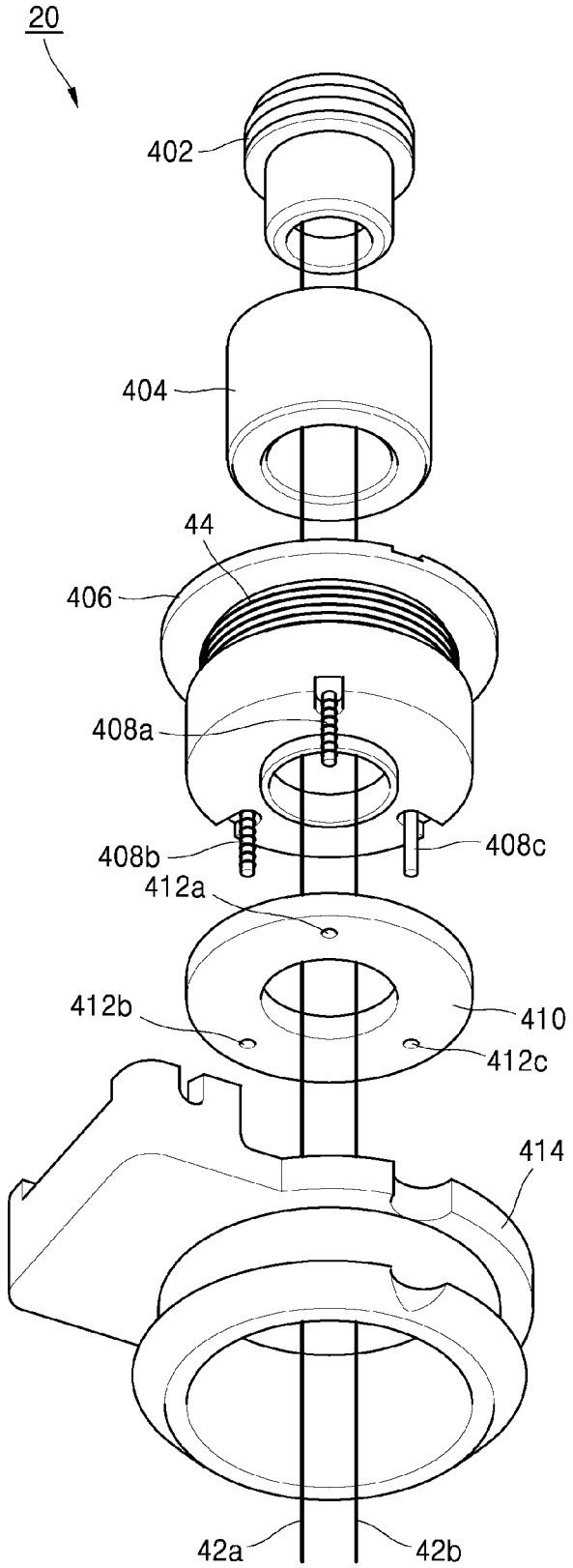
FIG. 4 is a perspective view illustrating respective components which form a vessel detecting sensor according to one embodiment of the present disclosure.
Figure 5:
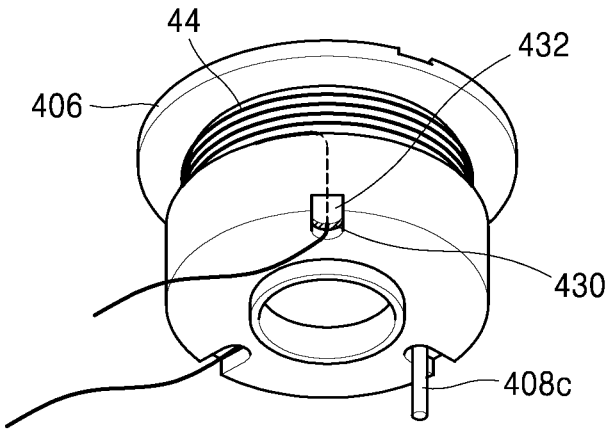
FIG. 5 is a perspective view illustrating components of a body included in the vessel detecting sensor according to one embodiment of the present disclosure.
Figure 6:
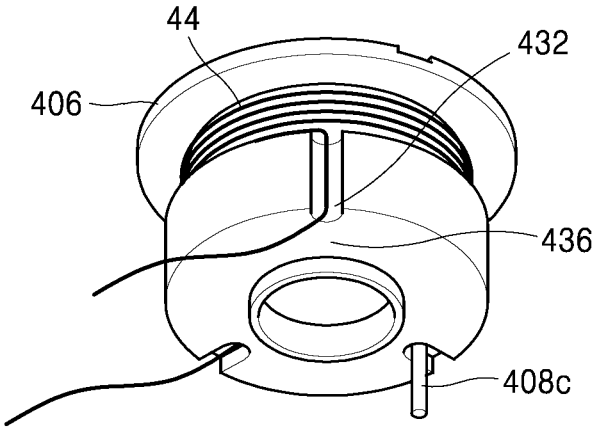
FIG. 6 is a perspective view illustrating components of a body included in a vessel detecting sensor according to another embodiment of the present disclosure.
Figure 7:
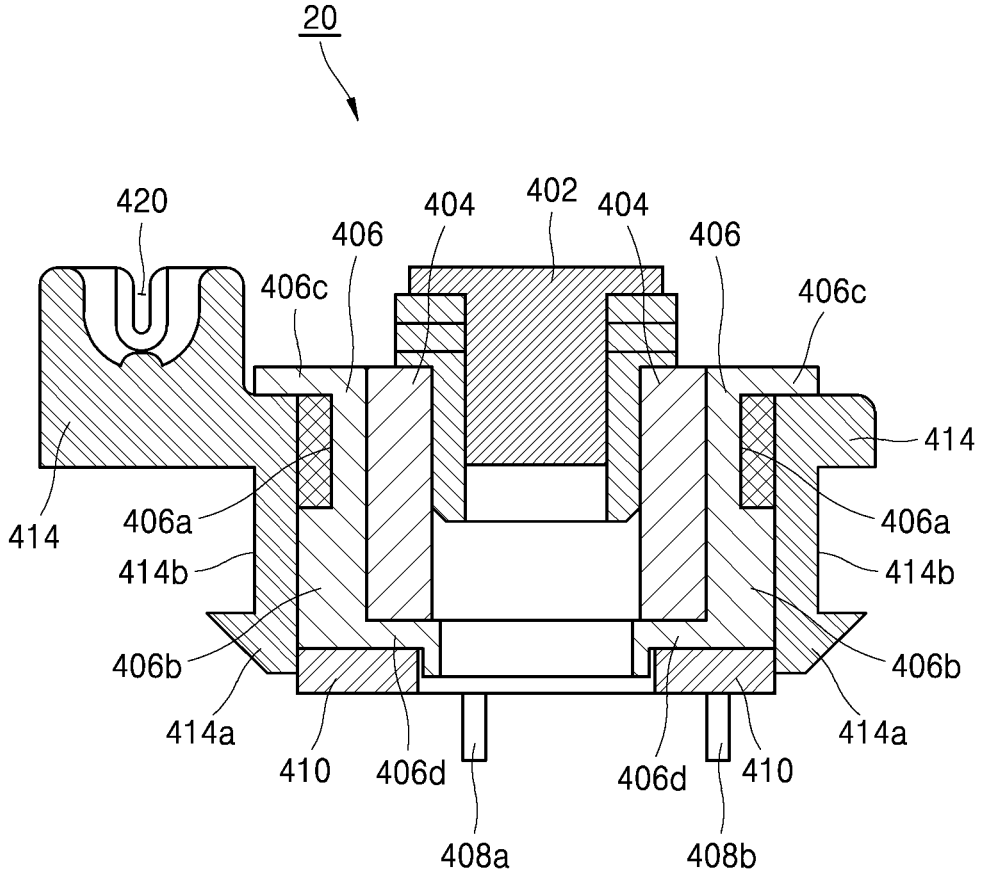
FIG. 7 is a longitudinal cross-sectional view illustrating a state in which the respective components which form the vessel detecting sensor are coupled with one another according to one embodiment of the present disclosure.

FIG. 4 is a perspective view illustrating respective components which form the vessel detecting sensor according to one embodiment of the present disclosure, and FIG. 5 is a perspective view illustrating components of the body included in the vessel detecting sensor according to one embodiment of the present disclosure. Also, FIG. 6 is a perspective view illustrating components of a body included in the vessel detecting sensor according to another embodiment of the present disclosure, and FIG. 7 is a longitudinal cross-sectional view illustrating a state in which the respective components which form the vessel detecting sensor are coupled according to one embodiment of the present disclosure.

Referring to the drawings, the vessel detecting sensor 20 according to one embodiment of the present disclosure includes a temperature sensor 402, a magnetic core 404, a body 406, a substrate 410, and a guide unit 414. The body 406 has a hollow cylindrical shape. A first accommodation space configured to accommodate the magnetic core 404 is formed in the body 406.

The magnetic core 404 has a hollow cylindrical shape. The magnetic core 404 may be formed of a magnetic material, for example, ferrite. The magnetic core 404 increases density of magnetic fluxes induced in the sensing coil 44 when currents flow through the sensing coil 44.

A space formed in the magnetic core 404 is defined as a second accommodation space. The temperature sensor 402 may be accommodated in the second accommodation space of the magnetic core 404. The temperature sensor 402 is a sensor configured to measure a temperature of an object to be heated and includes conductive wires 42*a* and 42*b* for electrical connection with the controller or the power supply. The conductive wires 42*a* and 42*b* of the temperature sensor 402 may pass through the other side of the magnetic core 404, the other side of the body 406, and the substrate 410 and be externally exposed.

Referring back to the drawings, a first barrier 406*c* configured to support the body 406 on one side of the guide unit 414 when the body 406 is inserted into the guide unit 414 is formed on one side of the body 406 along a perimeter of one side of the body 406. Also, a second barrier 406*d* configured to support the magnetic core 404 when the magnetic core 404 is inserted into the first accommodation space of the body 406 is formed on the other side of the body 406 along the perimeter of one side of the body 406.

Also, the sensing coil 44 is wound on an outer surface of the body 406 according to a predetermined number of rotations. A first outer surface 406*a* having a relatively small diameter and a second outer surface 406*b* having a greater diameter than that of the first outer surface 406*a* are formed on the outer surface of the body 406. The sensing coil is wound on the first outer surface 406*a* in one embodiment of the present disclosure.

As shown in the drawings, when the body 406 is inserted into a third accommodation space formed in the guide unit 414, the second outer surface 406*b* comes into contact with an inside of the third accommodation space of the guide unit 414 and the first outer surface 406*a* has a smaller diameter than that of the second outer surface 406*b* such that a space in which the sensing coil 44 may be accommodated is formed between the first outer surface 406*a* and the inside of the third accommodation space. Accordingly, when the body 406 is inserted into the guide unit 414 or withdrawn from the inside of the guide unit 414, contact between the sensing coil 44, which is wound on the first outer surface 406*a*, and an inner surface of the guide unit 414 does not occur.

It is necessary to withdraw the sensing coil 44 wound on the first outer surface 406*a* formed on the outer surface of the body 406 to the outside of the body 406 for electrical connection with the controller or the power supply. Accordingly, a coil withdrawal unit configured to withdraw the sensing coil 44 wound on the first outer surface 406*a* to the outside of the body 406 is formed on one side surface outside the body 406 according to the present disclosure.

For example, as shown in FIG. 5, a coil withdrawal unit 430 having a hole shape and configured to withdraw the sensing coil 44 wound on the first outer surface 406*a* to the outside of the body 406 may be formed on one side surface which comes into contact with the second outer surface 406*b* of the body 406. The sensing coil 44 withdrawn from one side of the body 406 through the coil withdrawal unit 430 may be electrically connected to the controller or the power supply immediately. In this case, a substrate which will be described below is not necessary. According to the above structure, the sensing coil 44 may be easily withdrawn outward from the body 406 without contact with the inside of the guide unit 414 while the body 406 is inserted in the guide unit 414. In another embodiment, the sensing coil 44 withdrawn from the onside of the body 406 may be wound on a lead pin (not shown) connected to a lead pin connection region 432 formed on one side surface of the body 406 and then extend in a predetermined direction through the substrate which will be described.

As another example, as shown in FIG. 6, a coil withdrawal unit 432 having a hole shape and configured to withdraw the sensing coil 44 wound on the first outer surface 406*a* to the outside of the body 406 may be formed on the second outer surface 406*b* of the body 406. The sensing coil 44 wound on the first outer surface 406*a* may pass through the coil withdrawal unit 432 having a groove shape as shown in FIG. 6, be withdrawn outward from the body 406, and be electrically connected to the controller or the power supply immediately. In this case, a substrate which will be described below is not necessary. According to the above structure, the sensing coil 44 may be easily withdrawn outward from the body 406 without contact with the inside of the guide unit 414 while the body 406 is inserted in the guide unit 414. In another embodiment, the sensing coil 44 withdrawn from the one side of the body 406 may be wound on a lead pin (not shown) connected to a lead pin connection region 436 formed on one side surface of the body 406 and then extend in a predetermined direction through the substrate which will be described.

The sensing coil 44 may be electrically connected to the controller or the power supply. In one embodiment of the present disclosure, currents for distinguishing a vessel to be heated under the control of the controller may be applied to the sensing coil 44.

Referring back to the drawings, lead pins 408*a*, 408*b*, and 408*c*, on which the sensing coil 44 wound on the first outer surface 406*a* and then withdrawn outward from the body 406 by the coil withdrawal unit 430 or 432 is wound, are arranged on one side surface outside the body 406. In FIG. 4, one end of the sensing coil 44 wound on the first outer surface 406*a* is wound on a first lead pin 408*a*, and the other end of the sensing coil 44 is wound on a second lead pin 408*b*. That is, at least two lead pins on which one end and the other end of the sensing coil 44 are wound may be disposed on one side surface outside the body 406. In the embodiment of FIG. 4, a third lead pin 408*c* configured to firmly couple the body 406 with the substrate 410 is additionally disposed.

The substrate 410 is disposed on one side surface of the body 406, in more detail, on one side surface on which the lead pins 408*a*, 408*b*, and 408*c* are arranged. The substrate 410 includes lead holes 412*a*, 412*b*, and 412*c* formed corresponding to the lead pins 408*a*, 408*b*, and 408*c* to allow the lead pins 408*a*, 408*b*, and 408*c* to pass therethrough. The lead pins 408*a*, 408*b*, and 408*c* arranged on one side surface of the body 406 pass through the lead holes 412*a*, 412*b*, and 412*c* of the substrate 410 such that the body 406 and the substrate 410 are coupled. As described below, the substrate 410 is coupled with one side surface of the body 406 and the sensing coil 44 wound on the lead pins 408*a* and 408*b* extends in a predetermined direction.

Referring back to the drawings, the body 406, which is coupled with the substrate 410 and accommodates the magnetic core 404 and the temperature sensor 402, is accommodated in the third accommodation space formed in the guide unit 414. The guide unit 414 performs a function of fixing the body 406, the magnetic core 404, and the temperature sensor 402 to a central region 230 of the coil base 206 as shown in FIG. 2. To this end, a coupling unit is formed on an outer surface of the guide unit 414.

In more detail, the coupling unit of the guide unit 414 includes a guide region 414*a* which includes an inclined surface for inducing the guide unit 414 to be inserted into the central region 230 to couple the guide unit 414 with the coil base 206 and a stepped unit which prevents the guide unit 414 from being separated from the central region 230 after the guide unit 414 is inserted into the central region 230. Also, the coupling unit of the guide unit 414 includes a coupling region 414*b* which has a diameter corresponding to a diameter of the central region 230 of the coil base 206 and maintains contact with the central region 230 when the guide unit 414 is inserted into the central region 230. According to such a structure, the guide unit 414 may be inserted into and coupled and fixed to the central region 230 of the coil base 206 shown in FIG. 2. Also, as shown in the drawings, an accommodation space 420 capable of accommodating another device or module, for example, the controller, may be formed on one side of the guide unit 414.

As described with reference to FIGS. 4 and 7, the vessel detecting sensor according to the present disclosure has functions of determining a type of an object, which is to be heated, using currents flowing through the sensing coil 44 while simultaneously measuring a temperature of the object, which is to be heated, using the temperature sensor 402. Particularly, as shown in the drawings, due to a structure in which the temperature sensor 402 is accommodated in the body 406, in comparison to a structure in which the temperature sensor 402 and the vessel detecting sensor are separately disposed, an overall size and volume of the induction heating device may be reduced and sensor arrangements and space utilization in the induction heating device become more flexible.

Figure 8:
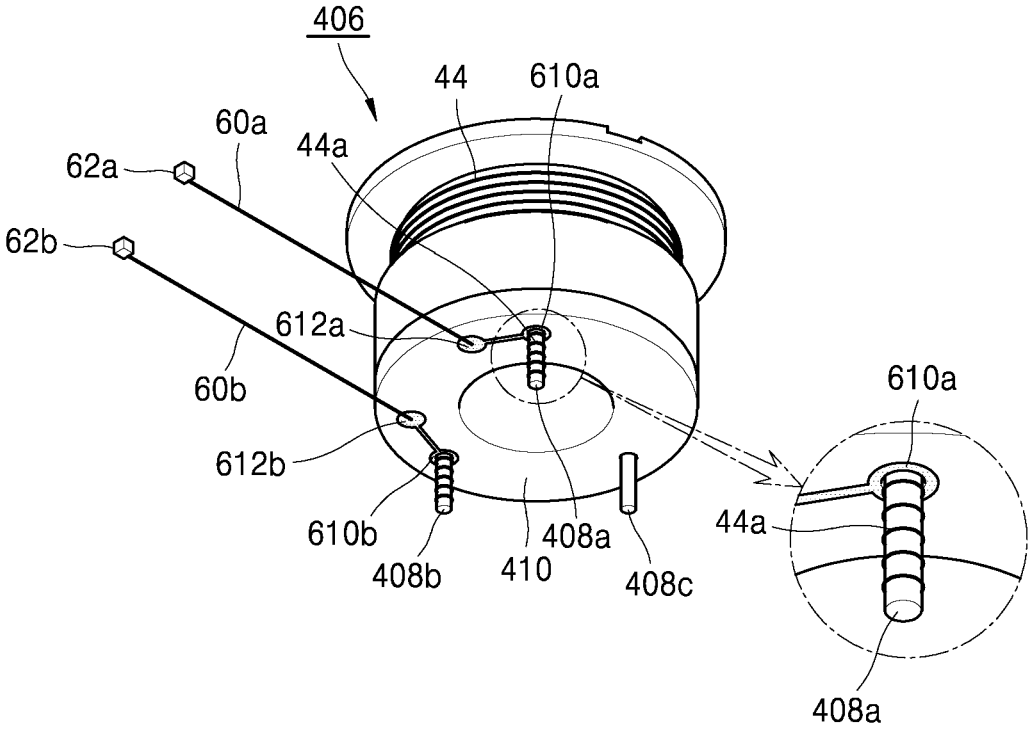
FIG. 8 is a perspective view illustrating a state in which the body and a substrate are coupled with each other according to one embodiment of the present disclosure.

FIG. 8 is a perspective view illustrating a state in which the body and the substrate are coupled with each other according to one embodiment of the present disclosure. FIG. 8 illustrates the body 406 and the substrate 410 when the lead pins 408*a*, 408*b*, and 408*c* pass through the lead holes 412*a*, 412*b*, and 412*c*, respectively, so that the body 406 and the substrate 410 are coupled with each other. As described above, one side of the sensing coil 44 wound on the outer surface of the body 406 is wound on the first lead pin 408*a*, and the other end of the sensing coil 44 is wound on the second lead pin 408*b*.

In one embodiment of the present disclosure, first pads 610*a* and 610*b* are formed on peripheries of a first lead hole 412*a* and a second lead hole 412*b* formed in the substrate 410, respectively. The first pads 610*a* and 610*b* are formed of conductors such as a metal and electrically connected to the sensing coils 44 wound on the first lead pin 408*a* and the second lead pin 408*b*, respectively, using a connection method such as soldering.

Also, the first pads 610*a* and 610*b* are electrically connected to second pads 612*a* and 612*b* formed on the substrate 410, respectively. The second pads 612*a* and 612*b* are formed of conductors such as a metal like the first pads 610*a* and 610*b*. Positions of the second pads 612*a* and 612*b* on the substrate 410 may vary according to an embodiment.

Conductive wires 60*a* and 60*b* formed of conductors such as a metal are connected to the second pads 612*a* and 612*b*, respectively. Also, the connectors 62*a* and 62*b* for connection with the controller or the power supply are connected to one ends of the conductive wires 60*a* and 60*b*, respectively.

According to an embodiment shown in FIG. 8, the sensing coil 44 wound on the outer surface of the body 406 may be electrically connected to the controller or the power supply through the first pads 610*a* and 610*b*, the second pads 612*a* and 612*b*, the conductive wires 60*a* and 60*b*, and the connectors 62*a* and 62*b*. As a result, the sensing coil 44 wound on the outer surface of the body 406 may extend in a predetermined direction due to the substrate 410.

As described above with reference to FIGS. 4 and 7, the body 406 according to the present disclosure is inserted into the third accommodation space of the guide unit 414 while the sensing coil 44 is wound thereon. The lead pins 408*a* and 408*b* according to the present disclosure perform a function of withdrawing both ends of the sensing coil 44 outward from the body 406 and the guide unit 414 while the body 406 is inserted into the guide unit 414.

Meanwhile, when the sensing coil 44 is wound on the lead pins 408*a* and 408*b* and withdrawn outward from the body 406 and the guide unit 414 and then both ends of the sensing coil 44 are directly connected to the controller or the power supply, a force caused by assembling or repairing of the vessel detecting sensor or vibrations and the like may be applied to the sensing coil 44. When a force is applied to the sensing coil 44 while both ends of the sensing coil 44 are directly connected to the controller or the power supply as described above, a phenomenon in which the sensing coil 44 is unwound from the lead pins 408*a* and 408*b* may occur or the sensing coil 44 may be broken.

However, when the sensing coil 44 connected to the lead pins 408*a* and 408*b* is electrically connected to the first pads 610*a* and 610*b* and the second pads 612*a* and 612*b* and the conductive wires 60*a* and 60*b* connected to the second pads 612*a* and 612*b* are connected to the controller or the power supply as shown in FIG. 8, even though a force is applied from the outside, it is possible to prevent a phenomenon in which the sensing coil 44 is unwound from the lead pins 408*a* and 408*b* or the sensing coil 44 is broken.

Also, when the sensing coil 44 wound on the lead pins 408*a* and 408*b* are directly connected to the controller or the power supply, a connection direction of the sensing coil 44 is restricted such that a position of the controller or the power supply is also restricted. However, when the sensing coil 44 connected to the lead pins 408*a* and 408*b* is electrically connected to the first pads 610*a* and 610*b* and the second pads 612*a* and 612*b* and the conductive wires 60*a* and 60*b* connected the second pads 612*a* and 612*b* are connected to the controller or the power supply as shown in FIG. 8, connection directions of the conductive wires 60*a* and 60*b* may be freely set according to positions of the second pads 612*a* and 612*b*. Accordingly, the position of the controller or the power supply may also be freely set.

Meanwhile, in another embodiment of the present disclosure, the second pads 612*a* and 612*b* may not be arranged on the substrate 410 and the conductive wires 60*a* and 60*b* may be electrically connected to the first pads 610*a* and 610*b* directly. In the above embodiment, a connection direction between the conductive wires 60*a* and 60*b* and the controller or the power supply may be freely set by adjusting connection points between the conductive wires 60*a* and 60*b* and the first pads 610*a* and 610*b*.

Figure 9:
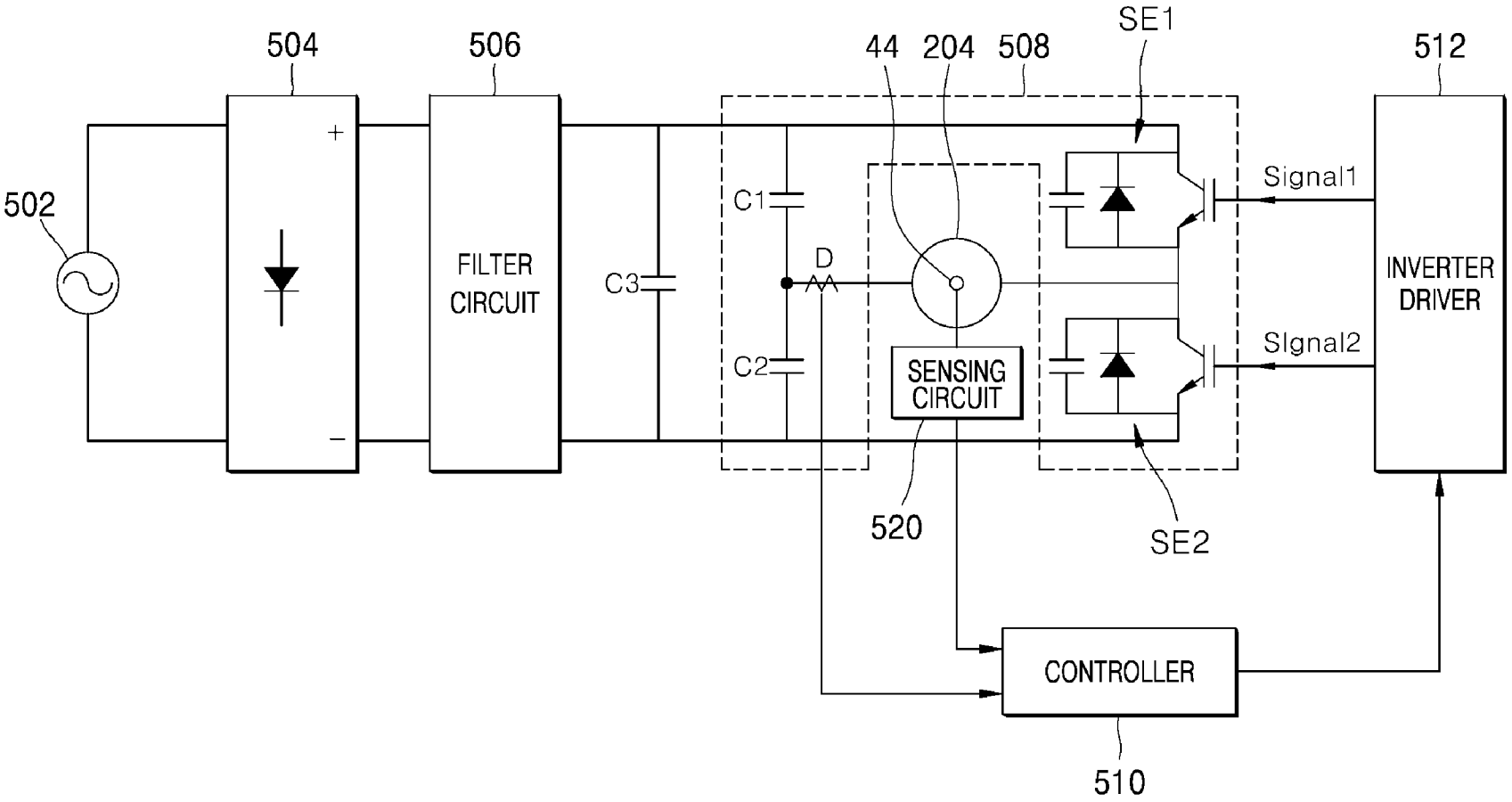
FIG. 9 illustrates a circuit configuration of the induction heating device according to one embodiment of the present disclosure.

FIG. 9 illustrates a circuit configuration of the induction heating device according to one embodiment of the present disclosure. A rectification circuit 504 rectifies and outputs alternating current (AC) power supplied from an input power source 502. The rectification circuit 504 may include one or more diodes, for example, bridge diodes and/or inductors for performing a rectification operation. According to an embodiment, a converter circuit including a switching element may be used instead of the rectification circuit 504.

A filter circuit 506 removes a ripple component which remains in a voltage output from the rectification circuit 504. According to an embodiment, a configuration of the filter circuit 506 may be omitted. Also, a smoothing capacitor C3 generates a direct current (DC) voltage by smoothing a voltage output from the filter circuit 506.

An inverter circuit 508 converts the DC voltage output from the smoothing capacitor C3 into an AC voltage through a switching operation performed by switching elements SE1 and SE2. The inverter circuit 508 may include one or more switching elements SE1 and SE2 for performing the switching operation. The switching elements SE1 and SE2 may be complementarily turned on and off by switching signals Signal1 and Signal2 generated by an inverter driver 512. A turning-on-and-turning-off operation of the switching elements SE1 and SE2 is referred to as a switching operation. Capacitors C2 and C3 corresponding to the switching elements SE1 and SE2 of the inverter circuit 508 are connected in parallel.

An AC current generated by the inverter circuit 508 is applied to the working coil 204. The working coil 204 causes a resonance phenomenon according to applying of the AC current, and a resonance current flows through the working coil 204 according to such a resonance phenomenon.

The inverter driver 512 outputs switching signals Signal1 and Signal2 according to a control signal output from a controller 510. A number per unit time at which the switching elements SE1 and SE2 are complimentarily turned on and turned off by the switching signals Signal1 and Signal2 output by the inverter driver 512, that is, an operating frequency of the inverter circuit 508, may vary according to the control signal output from the controller 510.

The controller 510 generates and supplies a control signal according to a predetermined operating frequency to the inverter driver 512. In one embodiment of the present disclosure, the controller 510 may set the operating frequency of the inverter circuit 508 as a predetermined sensing frequency in order to sense a first vessel.

A current sensor (or first sensor) D measures a level of the resonance current flowing through the working coil 204, that is, a resonance current value when the working coil 204 is driven. The controller 510 may determine whether a vessel is present in a heating region corresponding to the working coil 204 on the basis of the resonance current value of the working coil 204 measured by the current sensor D. In the present disclosure, a process of determining whether the vessel is present in the heating region corresponding to the working coil 204 on the basis of the resonance current value obtained by the controller 510 using the current sensor D is referred to as "first vessel sensing."

A first vessel sensing process will be described in detail as follows. When the first vessel sensing begins, the controller 510 sets the operating frequency of the inverter circuit 508 as a predetermined sensing frequency and generates and supplies a control signal corresponding to the set sensing frequency to the inverter driver 512 in order to determine whether a vessel is present in the heating region corresponding to the working coil 204.

The inverter driver 512 supplies the switching signals Signal1 and Signal2 corresponding to the control signal to the inverter circuit 508. Accordingly, the switching elements SE1 and SE2 of the inverter circuit 508 are complimentarily turned on and turned off such that AC currents are supplied to the working coil 204.

When AC currents are supplied to the working coil 204 such that the working coil 204 is driven, the resonance current value of the working coil 204 is measured by the current sensor D. The controller 510 determines whether a vessel is present in the heating region corresponding to the working coil 204 by comparing the resonance current value of the working coil 204 obtained using the current sensor D with a predetermined first reference value.

When the resonance current value of the working coil 204 is less than the first reference value, the controller 510 determines that the vessel is present in the heating region corresponding to the working coil 204. However, when the resonance current value of the working coil 204 is greater than or equal to the first reference value, the controller 510 determines that the vessel is not present in the heating region corresponding to the working coil 204.

Meanwhile, the controller 510 may determine whether the vessel is present in the heating region corresponding to the working coil 204 on the basis of a sensing value output from a sensing circuit (or second sensor) 520. In the present disclosure, a process in which the controller 510 determines whether the vessel is present in the heating region corresponding to the working coil 204 on the basis of the sensing value output from the sensing circuit 520 is referred to as "second vessel sensing."

Figure 10:
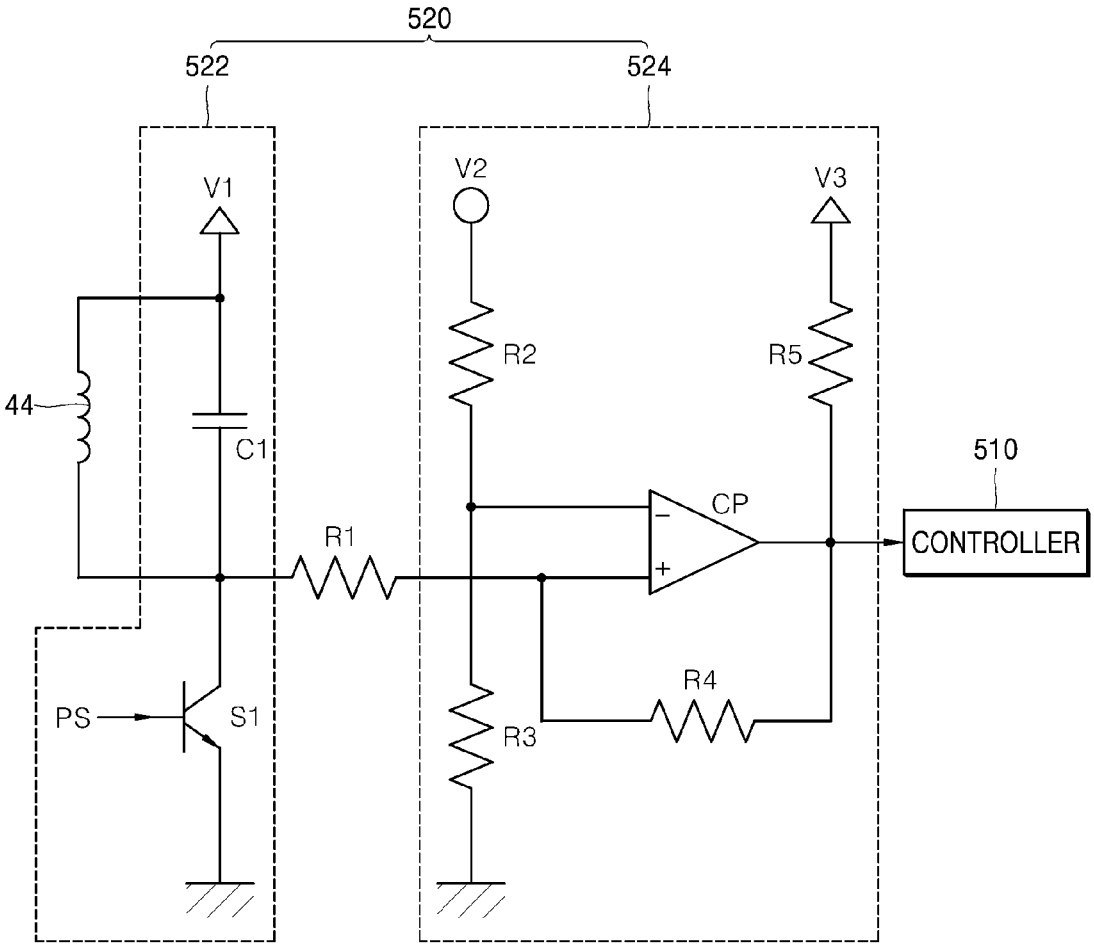
FIG. 10 illustrates a configuration of a sensing circuit of the induction heating device according to one embodiment of the present disclosure.

A configuration of the sensing circuit 520 and a detailed method of the second vessel sensing using the sensing circuit 520 according to the present disclosure will be described in detail with reference to FIGS. 10 to 14. FIG. 10 illustrates a configuration of the sensing circuit of the induction heating device according to one embodiment of the present disclosure.

Referring to FIG. 10, the sensing circuit 520 according to one embodiment of the present disclosure includes a resonance signal generation circuit 522 and a comparison circuit 524. The resonance signal generation circuit 522 includes a capacitor C1 connected to the sensing coil 44 in parallel. The sensing coil 44 and the capacitor C1 are connected between a ground terminal and a first power source V1 for supplying currents to the sensing coil 44 and the capacitor C1.

Also, the switching element S1 is connected between the ground terminal and the sensing coil 44 and the capacitor C1. When the second vessel sensing operation is started by the controller 510, the switching element S1 may repetitively perform a switching operation, that is, a turning-on-and-turning-off operation to allow currents having a predetermined amplitude and phase to flow through the sensing coil 44 and the capacitor C1. A switching signal PS having a predetermined cycle for the switching operation of the switching element S1 may be input to one end of the switching element S1.

When currents flow through the sensing coil 44 and the capacitor C1 due to power supplied from the first power source V1 according to the switching operation of the switching element S1, the sensing coil 44 and the capacitor C1 cause a resonance phenomenon (LC resonance). A resonance signal decreased over time according to the resonance phenomenon is generated, and the generated resonance signal is input to a comparator (CP) included in the comparison circuit 524.

The comparison circuit 524 generates a square wave by comparing the resonance signal generated by the resonance signal generation circuit 522 with a reference signal. The comparison circuit 524 includes the comparator CP which compares the resonance signal generated by the resonance signal generation circuit 522 with the reference signal generated by a second power source V2 and outputs a comparison result.

In more detail, the comparator CP compares a voltage level of the reference signal generated by the second power source V2 with a voltage level of the resonance signal generated by the resonance signal generation circuit 522 and outputs output signals having different voltage levels as a comparison result. The output signals output as described above show a waveform of a square wave. For example, when the voltage level of the resonance signal generated by the resonance signal generation circuit 522 is higher than or equal to the voltage level of the reference signal, the comparator CP may output a signal having a voltage level of a first level (for example, 5 V). When the voltage level of the resonance signal is less than the voltage level of the reference signal, the comparator CP may output a signal having a voltage level of a second level (for example, 0 V). Here, the voltage level of the reference signal generated by the second power source V2 may be set to be different by adjusting levels of voltage-dividing resistors R2 and R3.

The controller 510 may count a number of waveforms of a square wave output from the comparison circuit 524 and may determine whether the vessel is present in the heating region corresponding to the working coil 204 on the basis of the counted number of waveforms of the square wave. In the present disclosure, the number of waveforms of the square wave output from the comparison circuit 524 will be referred to as "sensing value."

Hereinafter, resonance signals generated by the resonance signal generation circuit 522 and a pattern of the square wave output by the comparison circuit 524 when a usable vessel is not present and when the usable vessel is present near the vessel detecting sensor according to the present disclosure will be described.

Figure 11:
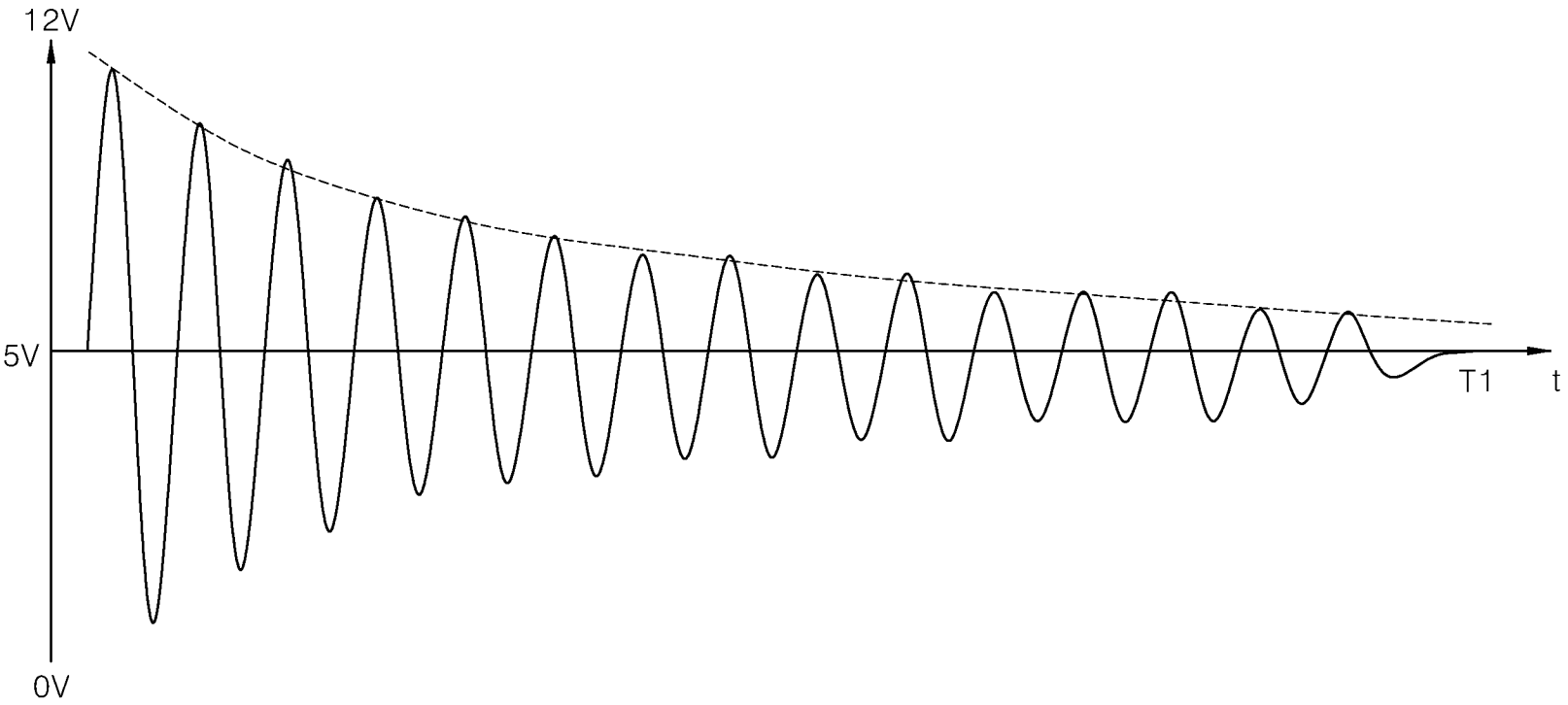
FIG. 11 illustrates a waveform of a resonance signal output by a resonance signal generation circuit of a vessel detecting sensor when a usable vessel is not present on a periphery of the vessel detecting sensor.
Figure 12:
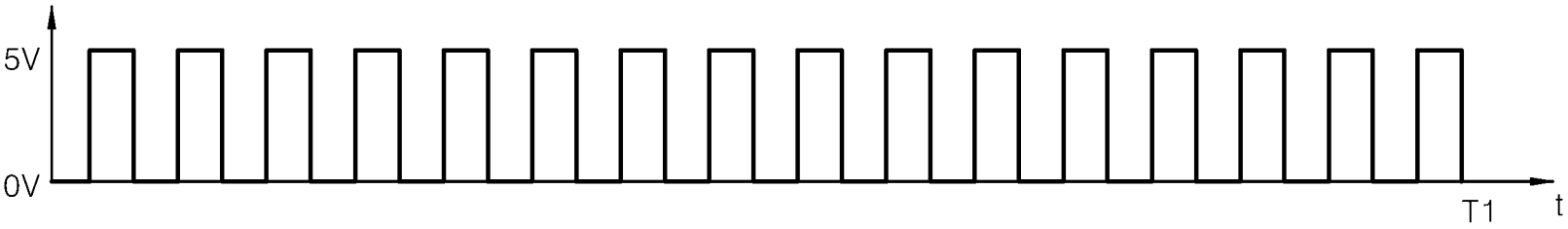
FIG. 12 illustrates a waveform of a square wave output when a comparison circuit of the vessel detecting sensor converts the resonance signal shown in FIG. 11.

FIG. 11 illustrates a waveform of a resonance signal output by the resonance signal generation circuit of a vessel detecting sensor when a usable vessel is not present on a periphery of the vessel detecting sensor, and FIG. 12 illustrates a waveform of a square wave output when the comparison circuit of the vessel detecting sensor converts the resonance signal shown in FIG. 11.

Referring to FIG. 11, when the vessel sensing operation performed by the controller 510 begins while a usable vessel is not present near the vessel detecting sensor according to the present disclosure, currents having predetermined amplitude and level are supplied to the sensing coil 44 and the capacitor C1 by the switching operation of the above-described switching element S1. The sensing coil 44 and the capacitor C1 show the LC resonance phenomenon due to supplying of the currents. Accordingly, a resonance signal generation circuit 522 outputs a resonance signal decreased according to time t as shown in FIG. 11.

When a usable vessel is not present near the vessel detecting sensor according to the present disclosure, impedances of the sensing coil 44 and the capacitor C1 circuit are maintained to be relatively low in comparison to a case in which a usable vessel is present. Accordingly, as shown in FIG. 11, the resonance signal output by the resonance signal generation circuit 522 is decreased for a relatively long time and dissipates at time t1.

The comparator CP of the comparison circuit 524, which receives the resonance signal as shown in FIG. 11, compares a voltage level of the input resonance signal with a voltage level (for example, 5 V) of the reference signal. Accordingly, the comparator CP outputs a signal at a first level (for example, 5 V) only when the voltage level of the resonance signal is higher than or equal to the voltage level of the reference signal. Otherwise, the comparator CP outputs a signal at a second level (for example, 0 V). The waveform according to the output signal output by the comparator CP is shown as a square wave as shown in FIG. 12. In the embodiment of FIG. 12, a total of sixteen square waves are generated from a point in time at which the vessel sensing operation starts until the time t1.

Figure 13:
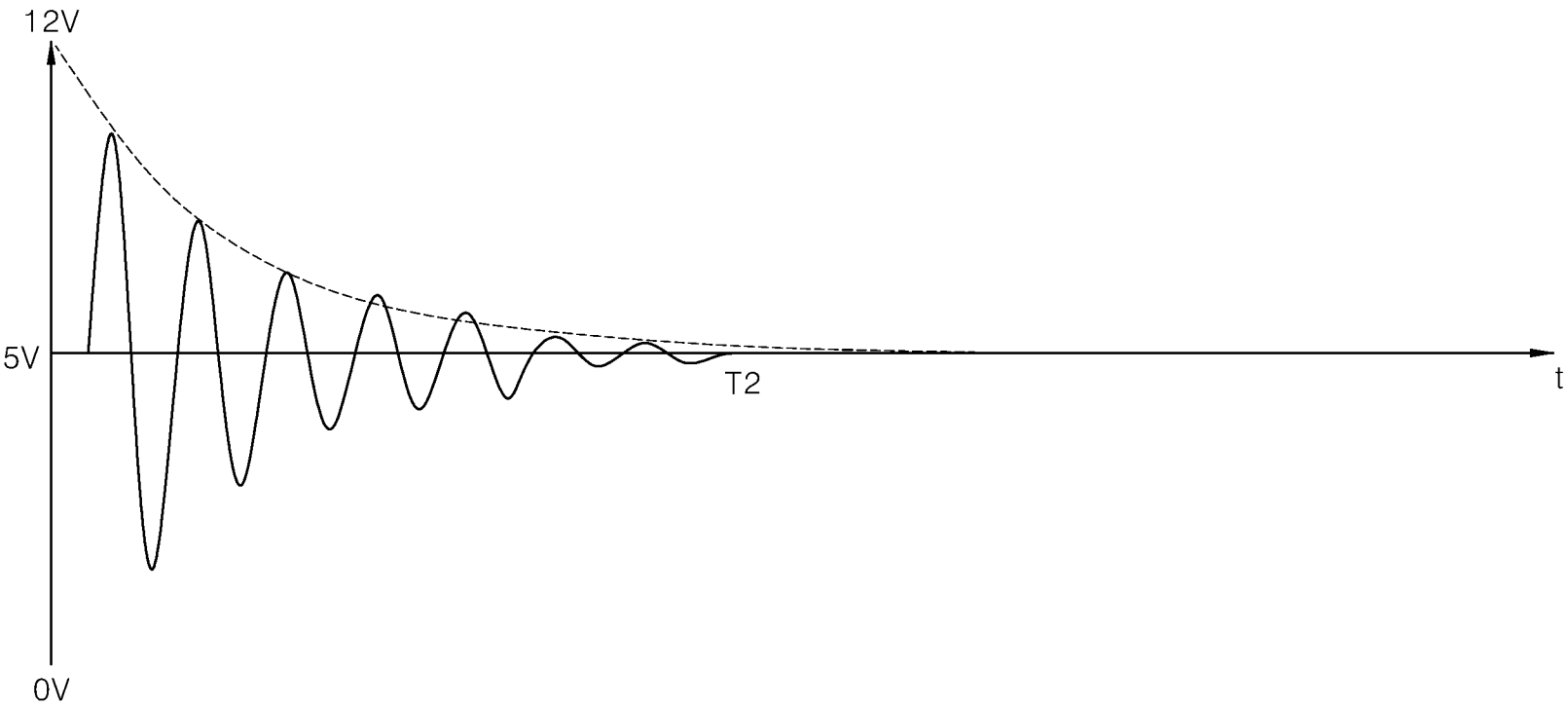
FIG. 13 illustrates a waveform of a resonance signal output by the resonance signal generation circuit when a usable vessel is present near the vessel detecting sensor.
Figure 14:
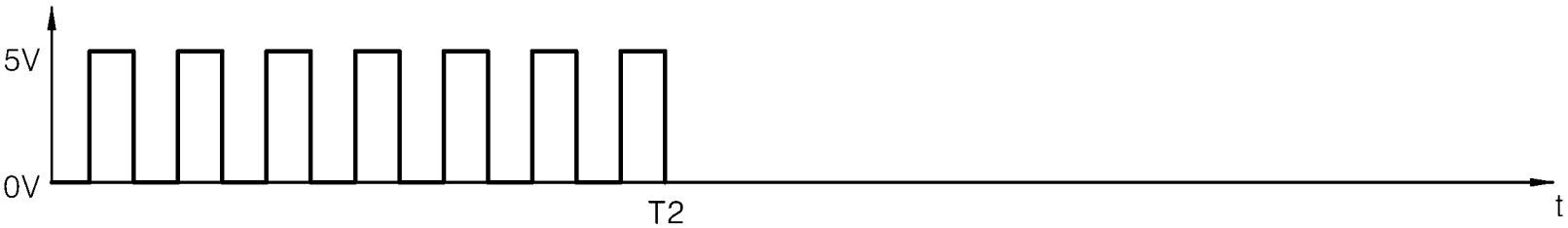
FIG. 14 illustrates a waveform of a square wave output when the comparison circuit of the vessel detecting sensor converts the resonance signal shown in FIG. 13.

FIG. 13 illustrates a waveform of a resonance signal output by the resonance signal generation circuit when a usable vessel is present near the vessel detecting sensor. Also, FIG. 14 illustrates a waveform of a square wave output when the comparison circuit of the vessel detecting sensor converts the resonance signal shown in FIG. 13.

Referring to FIG. 13, when the vessel sensing operation performed by the controller 510 begins while a usable vessel is present near the vessel detecting sensor according to the present disclosure, currents having a predetermined amplitude and level are supplied to the sensing coil 44 and the capacitor C1 by the switching operation of the above-described switching element S1. The sensing coil 44 and the capacitor C1 show the LC resonance phenomenon due to supplying of the currents. Accordingly, a resonance signal generation circuit 522 outputs a resonance signal decreased according to time t as shown in FIG. 13.

When a usable vessel is present near the vessel detecting sensor according to the present disclosure, impedances of the sensing coil 44 and the capacitor C1 circuit are shown as relatively high in comparison to a case in which a usable vessel is not present. Accordingly, as shown in FIG. 13, the resonance signal output by the resonance signal generation circuit 522 is decreased for a relatively short time and dissipates at time t2 in comparison to the embodiment of FIG. 11.

The comparator CP of the comparison circuit 524, which receives the resonance signal as shown in FIG. 13, compares a voltage level of the input resonance signal with a voltage level (for example, 5 V) of the reference signal. Accordingly, the comparator CP outputs a signal at a first level (for example, 5 V) only when the voltage level of the resonance signal is higher than or equal to the voltage level of the reference signal. Otherwise, the comparator CP outputs a signal at a second level (for example, 0 V). The waveform according to the output signal output from the comparator CP is shown as a square wave as shown in FIG. 14. In the embodiment of FIG. 14, a total of seven square waves are generated from a point in time at which the vessel sensing operation starts until the time t2.

Ultimately, as described with reference to FIGS. 11 to 14, the number of waveforms of the square wave output by the comparison circuit 524 when a usable vessel is not present near the vessel detecting sensor, that is, a sensing value, is higher than or equal to the number of waveforms of the square wave output by the comparison circuit 524 when a usable vessel is present near the vessel detecting sensor.

Accordingly, it is possible to determine whether a vessel is present in the heating region corresponding to the working coil 204 on the basis of the number of waveforms of the square wave output by the vessel detecting sensor, that is, the sensing value. For example, the controller 510 may determine that a vessel is present in the heating region corresponding to the working coil 204 when the counted number of waveforms of the square wave, that is, the sensing value, is smaller than or equal to a predetermined reference value and may determine that a vessel is not present in the heating region corresponding to the working coil 204 when the sensing value is higher than the predetermined reference value.

However, the resonance signal output by the resonance signal generation circuit 522 as shown in FIG. 11 or 13 and the number of waveforms of the square wave output by the comparison circuit 524 as shown in FIG. 12 or 14 tend to vary according to a temperature of a vessel placed on a top end of the vessel detecting sensor. That is, even when sensing the same vessel is performed using the vessel detecting sensor as described, as a temperature of the vessel varies, the resonance signal output by the resonance signal generation circuit 522 and the number of waveforms of the square wave output by the comparison circuit 524, that is, the sensing value, are shown as different.

When whether the vessel is present is determined using the vessel detecting sensor as described above, the sensing value may vary according to the temperature of the vessel. Accordingly, when sensing the vessel is performed in consideration of the sensing value obtained using the vessel detecting sensor, it is difficult to precisely sense the vessel due to an influence of the temperature of the vessel when the vessel is sensed.

In the present disclosure, to remedy the problem, sensing the vessel is performed on the basis of a sensing value variation which is a variation of a sensing value during a predetermined sensing time. That is, the controller 510 may determine whether a vessel is present in the heating region corresponding to the working coil 204 by calculating a variation of the sensing value measured before and after a predetermined sensing time, for example, 500 ms, and comparing the calculated variation of the sensing value with a predetermined reference value. The variation of the sensing value may be defined as a gradient of the sensing value for the sensing time. In the present disclosure, a process of sensing a vessel on the basis of the variation of the sensing value, which is the variation of the sensing value during the predetermined sensing time, will be referred to as "second vessel sensing."

As described above, since a vessel is sensed on the basis of a relative variation of a sensing value during a particular time, that is, a sensing time without sensing values at respective points in time obtained by the vessel detecting sensor, it is possible to precisely determine whether the vessel is present regardless of a temperature of the vessel.

As described above, the controller 510 of the induction heating device according to the present disclosure may determine whether the vessel is present in the heating region corresponding to the working coil using the first vessel sensing based on the resonance current value obtained by the current sensor when the working coil operates at the sensing frequency and the second vessel sensing based on the variation of the sensing value obtained by the vessel detecting sensor during the sensing time. Particularly, in one embodiment of the present disclosure, the controller 510 sequentially performs the first vessel sensing and the second vessel sensing before a heating operation for the heating region corresponding to the working coil is started or after the heating operation for the heating region is finished.

Figure 15:
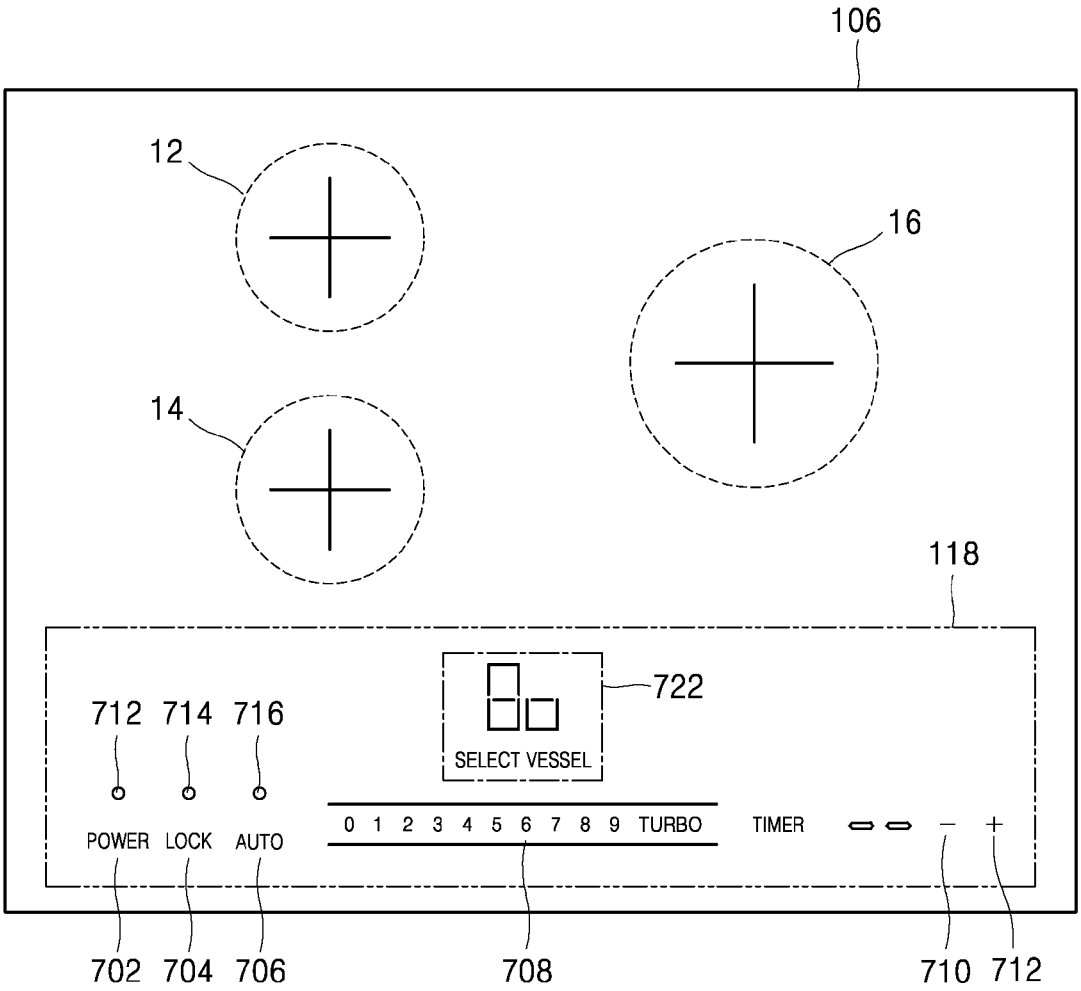
FIG. 15 illustrates a configuration of an upper panel of the induction heating device according to one embodiment of the present disclosure.
Figure 16A:
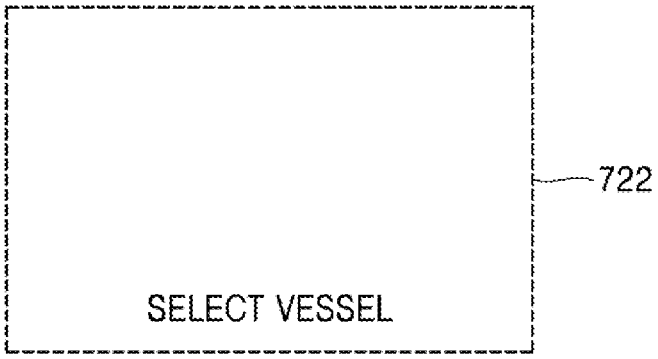
FIGS. 16A to 16C illustrate information displayed on a vessel selection region when operations of sensing and heating a vessel are performed according to one embodiment of the present disclosure.
Figure 16B:
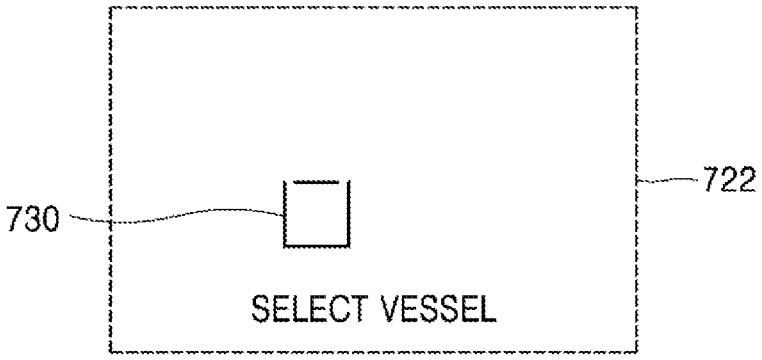
Figure 16C:
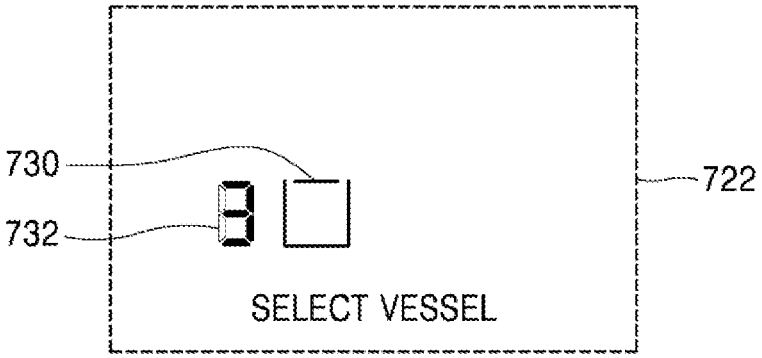

FIG. 15 illustrates a configuration of the upper panel of the induction heating device according to one embodiment of the present disclosure. Also, FIGS. 16A to 16C illustrate information displayed on a vessel selection region when operations of sensing and heating a vessel are performed according to one embodiment of the present disclosure.

Referring to FIG. 15, a plurality of heating regions 12, 14, and 16 are formed on the upper panel 106 of the induction heating device according to one embodiment of the present disclosure. Although an embodiment in which three heating regions 12, 14, and 16 are formed on the upper panel 106 is shown in FIG. 15, one or more heating regions may be formed on the upper panel 106 according to an embodiment.

Also, the manipulation region 118 may be formed on the upper panel 106. The manipulation region 118 includes a power button 702, a power lamp 712, a locking button 704, a locking lamp 714, an automatic sensing button 706, an automatic sensing lamp 716, a heating power adjustment button 708, timer buttons 710 and 712, and a vessel selection region 722.

When the user touches the power button 702 for a certain amount of time (for example, two seconds), power of the induction heating device is applied and the power lamp 712 is turned on. When the user touches the power button 702 for a certain amount of time (for example, two seconds) while the power of the induction heating device is applied, supplying of the power of the induction heating device is stopped and the power lamp 712 is turned off.

When the user touches the locking button 704 for a certain amount of time (for example, two seconds) while the power of the induction heating device is applied, all of the other buttons except the locking button 704 change to a locked state in which an operation is impossible and the locking lamp 714 is turned on. When the user touches the locking button 704 for a certain amount of time (for example, two seconds) in the locking state, all of the buttons change to an unlocked state in which an operation is possible and the locking lamp 714 is turned off.

When the user touches the automatic sensing button 706 for a certain amount of time (for example, two seconds) while the power of the induction heating device is applied, the induction heating device changes to an automatic sensing mode in which whether a vessel is present on each of the heating regions 12, 14, and 16 is automatically sensed and displayed and the automatic sensing lamp 716 is turned on. When the user touches the automatic sensing button 706 for a certain amount of time (for example, two seconds) in the automatic sensing mode, the automatic sensing mode is ended and the automatic sensing lamp 716 is turned off.

While the power of the induction heating device is applied, the user may touch each of vessel selection buttons displayed on the vessel selection region 722 to select a heating region to be used. The respective vessel selection buttons displayed on the vessel selection region 722 correspond one to one to the respective heating regions 12, 14, and 16.

When the vessel selection button is touched, a vessel mark displayed on the touched vessel selection button blinks. While the vessel mark blinks, the user may set heating power for the selected heating region by touching a number button or a turbo button included in the heating power adjustment button 708. When setting of heating power is finished, the induction heating device starts a heating operation corresponding to the heating power set by the user for the heating region selected by the user. Also, the user may set a time for performing the heating operation by touching the timer buttons 710 and 712 while the power of the induction heating device is applied.

FIGS. 16A to 16C illustrate a phase change of the vessel selection region 722 according to the vessel selection and heating power setting of the user. When the induction heating device is not set to the automatic sensing mode while the power of the induction heating device is applied, no information is displayed on the vessel selection region 722 as shown in FIG. 16A.

When the induction heating device is set to the automatic sensing mode, the controller 510 of the induction heating device performs the first vessel sensing a predetermined number of times for each of the heating regions 12, 14, and 16. When the first vessel sensing is finished, the controller 510 continuously performs the second vessel sensing until a predetermined pause time passes from the end of the first vessel sensing, and the heating operation for each of the heating regions 12, 14, and 16 is started. When the controller 510 determines that a vessel is not present in each of the heating regions 12, 14, and 16 through the first vessel sensing and the second vessel sensing, no information is displayed on the vessel selection region 722 as shown in FIG. 16A.

When the user places a vessel on the heating region 14 while the induction heating device is set to the automatic sensing mode, the controller 510 checks that the vessel is present in the heating region 14 through the first vessel sensing or the second vessel sensing. When it is checked that the vessel is present in the heating region 14, the vessel mark on the vessel selection button 730 is turned on as shown in FIG. 16B. Accordingly, the user may recognize that the vessel placed on the heating region 14 is recognized by the induction heating device and that the heating operation for the corresponding vessel is available.

As shown in FIG. 16B, when the vessel mark on the vessel selection button 730 is turned on, the user touches the vessel selection button 730 for a certain amount of time (for example, two seconds). Accordingly, the vessel mark displayed on the vessel selection button 730 blinks. While the vessel mark blinks, the user sets heating power for the heating region by touching the number button or the turbo button included in the heating power adjustment button 708. For example, when the user touches "3" among the heating power adjustment button 708, a heating power 3 set by the user is displayed on a left side of the vessel selection button 730.

When a certain amount of time (for example, two seconds) passes after the user touches the heating power adjustment button 708, the heating power for the heating region 14 is set to be 3, and sequentially the heating operation for the heating region 14 is started. When the heating operation for the heating region is started, the controller 510 stops a vessel sensing operation for the heating region 14 until the heating operation for the heating region 14 is finished. Here, the controller 510 continuously performs vessel sensing for the other heating regions 12 and 16 in which the heating operation is not started. After the heating operation for the heating region 14 is started and performed, the user may finish the heating operation for the heating region 14 by touching the vessel selection button 730.

When the heating operation for the heating region 14 is finished, the controller 510 performs the first vessel sensing again a predetermined number of times for the heating region 14. When the first vessel sensing is finished, the controller 510 continuously performs the second vessel sensing until a predetermined pause time passes from the end of the first vessel sensing, and the heating operation for the heating regions 14 is started.

Figure 17:
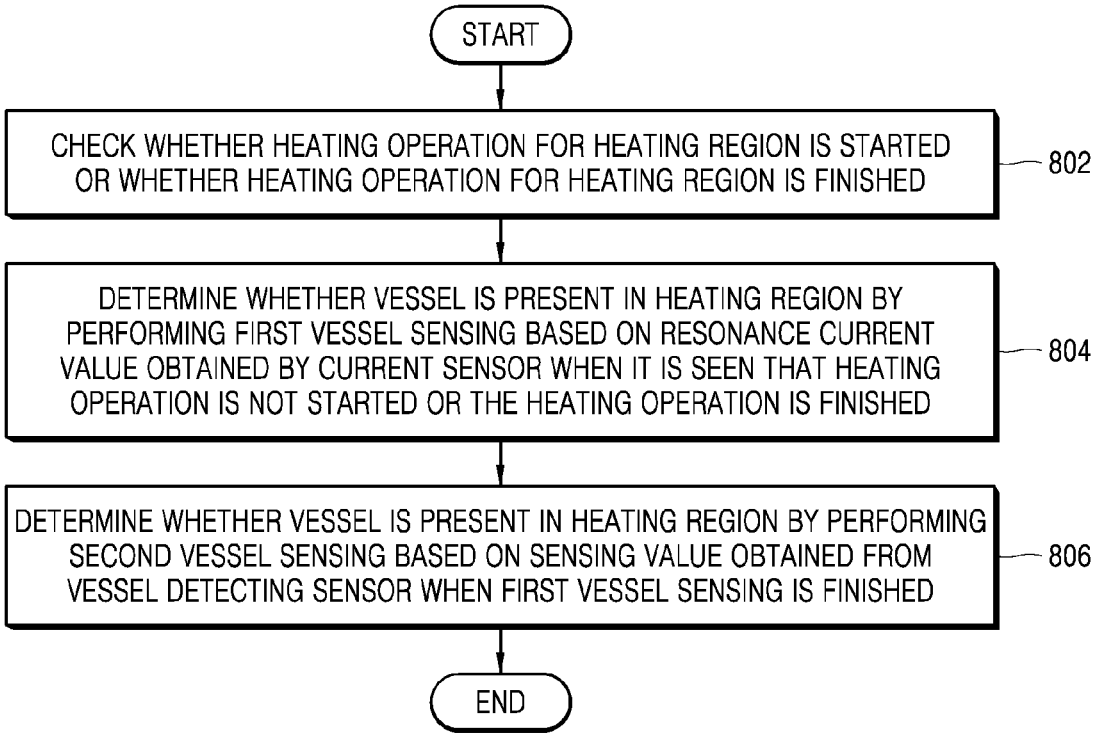
FIG. 17 is a flowchart illustrating a vessel sensing method of an induction heating device according to one embodiment of the present disclosure.

FIG. 17 is a flowchart illustrating a vessel sensing method of an induction heating device according to one embodiment of the present disclosure. Referring to FIG. 17, first, the controller 510 of the induction heating device according to one embodiment of the present disclosure checks whether the heating operation for the heating region is started or whether the heating operation for the heating region is finished (802).

As described above, the vessel sensing is performed for the heating region only before the heating operation for the heating region is started or after the heating operation is finished. That is, the vessel sensing is not performed for the heating region while the heating operation is performed for the heating region.

Next, when it is seen that the heating operation is not started or the heating operation is finished, the controller 510 determines whether a vessel is present in the heating region by performing the first vessel sensing on the basis of a resonance current value obtained by the current sensor D (804). In one embodiment of the present disclosure, operation 804 of determining whether a vessel is present in the heating region by performing the first vessel sensing may include determining that a vessel is present in the heating region when a resonance current value obtained while the working coil operates according to a predetermined sensing frequency is less than a predetermined first reference value and determining that a vessel is not present in the heating region when the resonance current value obtained while the working coil operates according to the predetermined sensing frequency is greater than or equal to the predetermined first reference value.

Also, in one embodiment of the present disclosure, operation 804 of determining whether a vessel is present in the heating region by performing the first vessel sensing may include performing the first vessel sensing a predetermined number of times and confirming whether a vessel is present in the heating region only when all results of performing the first vessel sensing for each number of times of sensing are equal.

When whether a vessel is present is checked by performing the first vessel sensing only once before the heating operation is started or after the heating operation is finished, there is a probability that the vessel sensing is not precisely performed due to whether a heating operation of another heating region is performed or due to a high temperature of the heating region after the heating region is finished.

Accordingly, in one embodiment of the present disclosure, the controller 510 may determine that a vessel is present in the heating region only when a predetermined sensing number, for example, performing the first vessel sensing twice, and it is determined that the vessel is present in all results of the performing of the first vessel sensing twice. When the results of the performing of the first vessel sensing twice differ from each other, the controller 510 may determine that the vessel is not present in the heating region.

Next, when the first vessel sensing is finished, the controller 510 determines whether a vessel is present in the heating region by performing second vessel sensing on the basis of a sensing value obtained by the vessel detecting sensor (806). In one embodiment of the present disclosure, the second vessel sensing of operation 806 may be started after a predetermined pause time passes from a point in time when the first vessel sensing of operation 804 is finished.

Also, in one embodiment of the present disclosure, the controller 510 may obtain a sensing value from the vessel detecting sensor whenever a predetermined sensing time passes.

Also, in one embodiment of the present disclosure, operation 806 of determining whether a vessel is present in the heating region by performing the second vessel sensing may include determining whether a vessel is present in the heating region by comparing a sensing value variation, which is a variation of a sensing value during a predetermined sensing time, with a predetermined second reference value when the second vessel sensing is performed before the heating operation for the heating region is started.

Also, in one embodiment of the present disclosure, operation 806 of determining whether a vessel is present in the heating region by performing the second vessel sensing may include determining that the vessel is present in the heating region when the sensing value variation which is the variation of the sensing value during the predetermined sensing time is greater than zero and the sensing value variation is greater than or equal to the predetermined second reference value, and determining that the vessel is not present in the heating region when the sensing value variation is greater than zero and the sensing value variation is less than the predetermined second reference value.

Also, in one embodiment of the present disclosure, operation 806 of determining whether a vessel is present in the heating region by performing the second vessel sensing may include determining whether the vessel is present in the heating region by comparing a sensing value variation, which is a variation of a sensing value during a predetermined sensing time, with a predetermined third reference value when the second vessel sensing is performed after the heating operation for the heating region is finished.

Also, in one embodiment of the present disclosure, operation 806 of determining whether a vessel is present in the heating region by performing the second vessel sensing may include determining that the vessel is present in the heating region when the sensing value variation which is the variation of the sensing value during the predetermined sensing time is smaller than zero and the sensing value variation is smaller than or equal to the predetermined third reference value, and determining that the vessel is not present in the heating region when the sensing value variation is smaller than zero and the sensing value variation is greater than the predetermined third reference value.

Figure 18:
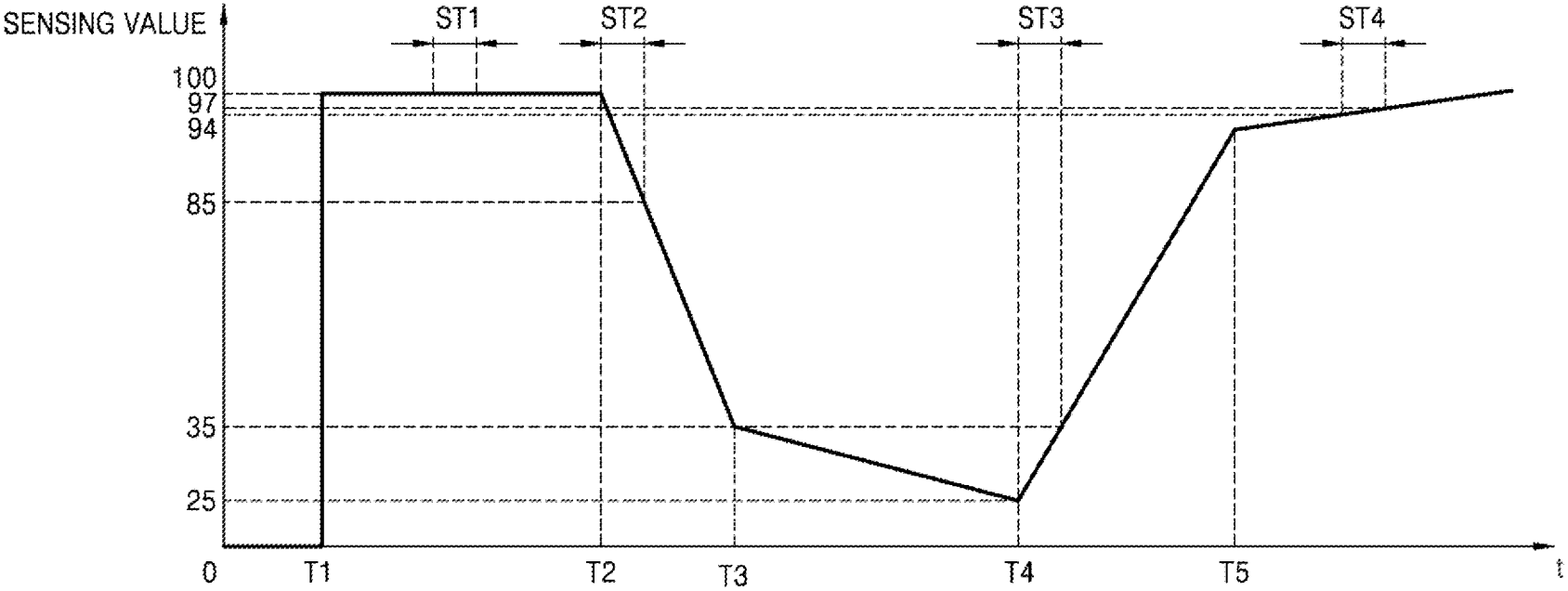
FIG. 18 is a graph illustrating a change of a sensing value measured by the vessel detecting sensor before and after performing a heating operation of the induction heating device according to one embodiment of the present disclosure.

FIG. 18 is a graph illustrating a change in a sensing value measured by the vessel detecting sensor before and after performing a heating operation of the induction heating device according to one embodiment of the present disclosure. Also, FIG. 19 is a flowchart illustrating a vessel sensing method performed before the heating operation is started in one embodiment of the present disclosure, and FIG. 20 is a flowchart illustrating a vessel sensing method performed after the heating operation is performed according to one embodiment of the present disclosure.

FIG. 18 illustrates changes in the sensing value measured by the vessel detecting sensor after power of the induction heating device is applied and until a user commands the heating operation for the heating region such that the heating operation for the heating region is performed and finished.

Figure 19:
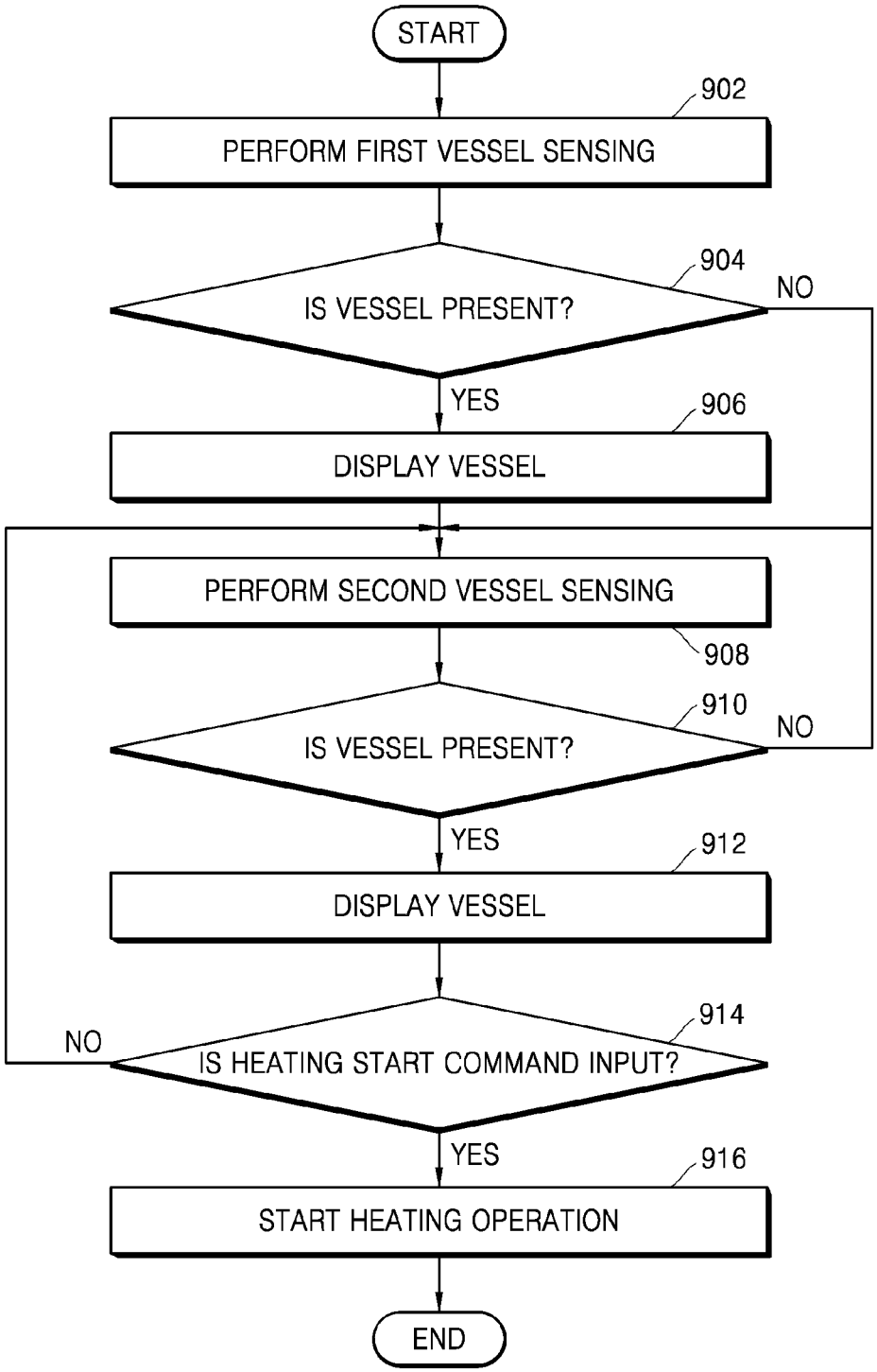
FIG. 19 is a flowchart illustrating a vessel sensing method performed before the heating operation is started in one embodiment of the present disclosure.
Figure 20:
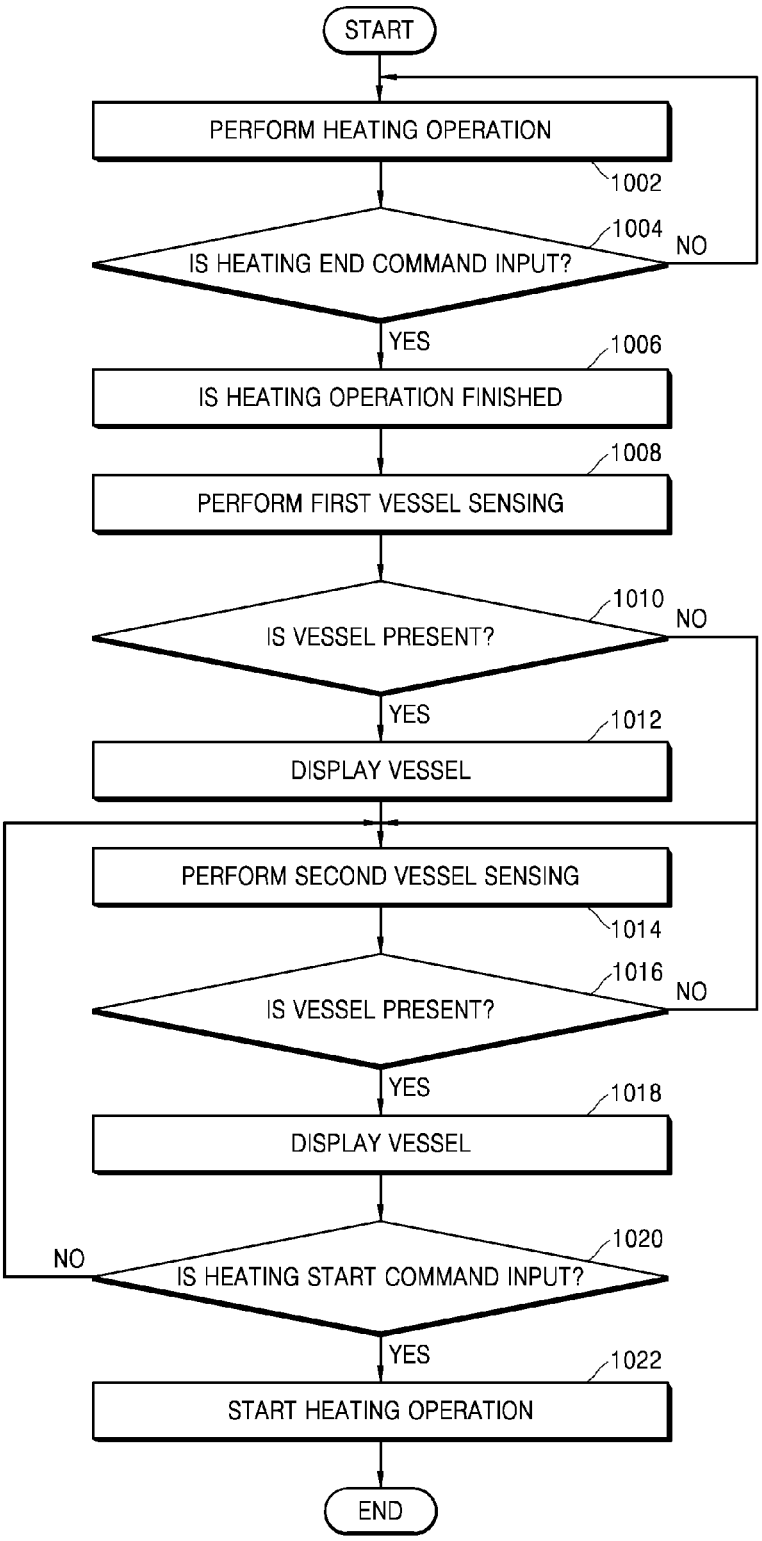
FIG. 20 is a flowchart illustrating a vessel sensing method performed after the heating operation is performed according to one embodiment of the present disclosure.

First, referring to FIGS. 18 and 19, power of the induction heating device is applied by the user. In FIG. 18, a section 0 to T1 is a section in which power of the induction heating device is applied and then the controller 510 determines whether a vessel is present in the heating region through the first vessel sensing. Accordingly, in the section 0 to T1, the controller 510 performs the first vessel sensing (902) and does not perform the second vessel sensing. In the section 0 to T1, a sensing value is maintained as zero.

In the section 0 to T1, the controller 510 determines whether a vessel is present in the heating region by comparing a resonance current value obtained by the first vessel sensing with a predetermined first reference value (904). In one embodiment of the present disclosure, the controller 510 may perform the first vessel sensing a predetermined number of times and may determine whether the vessel is present in the heating region only when all results of performing the first vessel sensing for each number of times of sensing are equal.

In operation 902, when the obtained resonance current value is less than a first reference value, the controller 510 determines that the vessel is present in the heating region. When it is determined that the vessel is present in the heating region, the controller 510 displays the presence of the vessel by turning on a vessel mark on a vessel selection button of the vessel selection region 722 (906) and performs the second vessel sensing (908).

However, in operation 904, when the obtained resonance current value is greater than or equal to the first reference value, the controller 510 determines that the vessel is not present in the heating region. Accordingly, the controller 510 performs the second vessel sensing without displaying the presence of the vessel by turning off the vessel mark of the vessel selection button (908).

In the section 0 to T1, when the first vessel sensing is finished, the controller 510 performs the second vessel sensing at a time point T1 (908). A section T1 to T2 is a section in which the controller 510 obtains a sensing value through the vessel detecting sensor and the sensing circuit whenever a predetermined sensing time (for example, 500 ms) passes and repetitively performs the second vessel sensing.

In the section T1 to T2, since the user does not place a vessel in the heating region, the sensing value is continuously maintained as the same value, that is, 100. Accordingly, in the section T1 to T2, a variation of the sensing value during a sensing time is continuously maintained as zero. For example, since the sensing value is maintained to be equal in a sensing time ST1, a sensing value variation is shown as zero.

The controller 510 determines whether a vessel is present in the heating region by comparing the sensing value variation (for example, zero) in the section T1 to T2 with a predetermined second reference value (for example, 10) (910). Since the sensing value variation is less than the second reference value as a comparison result, the controller 510 determines that a vessel is not present in the heating region. Accordingly, the controller 510 continuously performs the second vessel sensing (908).

Next, a time point T2 is a point in time at which the user starts placing a vessel in the heating region and a time point T3 is a point in time at which the user completes setting of heating power for the heating region and the heating operation for the heating region is started. At the time point T2, when the user starts placing the vessel in the heating region, the sensing value obtained by the controller 510 is rapidly decreased. Accordingly, in a section T2 to T3, a variation of the sensing value during a sensing time increases more than the sensing value variation of the section T1 to T2. For example, a sensing value variation during a sensing time ST2 is a value obtained by subtracting 85 from 100, that is, 15.

The controller 510 determines whether a vessel is present in the heating region by comparing the sensing value variation (15) in the sensing time ST2 with a predetermined second reference value (for example, 10) (910). Since the sensing value variation (15) is greater than or equal to the second reference value (10) as a comparison result, the controller 510 determines that a vessel is present in the heating region. Accordingly, the controller 510 displays the presence of the vessel by turning on the vessel mark on the vessel selection button of the vessel selection region 722 (912). When the vessel is not present, the controller 510 turns off the vessel mark of the vessel selection button of the vessel selection region 722.

The controller 510 continuously checks whether a heating start command for the heating region in which the vessel is present is input (914). When the heating start command is not input, the controller 510 continuously performs the second vessel sensing (908). At the time point T3, when the heating start command for the heating region is input, the controller 510 starts the heating operation for the heating region (916) and stops the vessel sensing for the heating region.

Meanwhile, when the heating operation is not started after the time point T3, the sensing value will be continuously maintained as 35. However, when the heating operation is started at the time point T3, a temperature of the vessel gradually increases. As shown in a section T3 to T4 of FIG. 18, as the temperature of the vessel increases, the sensing value is gradually decreased.

Next, referring to FIGS. 18 and 20, the controller 510 performs the heating operation according to the heating start command of the user (1002). Then, the controller 510 checks whether a heating end command is input by the user (1004). When the heating end command is not input, the controller 510 continuously performs the heating operation (1002). When the user inputs the heating end command for the heating region at a time point T4, the controller 510 finishes the heating operation (1006).

The controller 510 determines whether the vessel is present in the heating region by performing the first vessel sensing again (1008). When the vessel is present as a result of the determination (in 1008), the controller 510 displays the presence of the vessel by turning on the vessel mark on the vessel selection button of the vessel selection region 722 (1012) and turns off the vessel mark otherwise.

In one embodiment of the present disclosure, the controller 510 may perform the first vessel sensing a predetermined number of times and may determine whether a vessel is present in the heating region only when all results of performing the first vessel sensing for each number of times of sensing are equal.

When the first vessel sensing is finished, the controller 510 repetitively performs the second vessel sensing after a pause time passes (1014). At the time point T4, the user starts removing the vessel in the heating region after the heating operation is finished, and the vessel is completely removed at a time point T5. Accordingly, the sensing value rapidly increases in a section T4 to T5. The controller 510 determines whether a vessel is present in the heating region by calculating a variation of the sensing value during a sensing time in the section T4 to T5 and comparing a calculated sensing value variation with a predetermined third reference value (for example, −8) (1016).

For example, a sensing value variation during a sensing time ST3 is a value obtained by subtracting 35 from 25, that is, −10. The controller 510 compares the sensing value variation (−10) of the sensing time ST3 with the predetermined third reference value (for example, −8). Since the sensing value variation (−10) is less than or equal to the third reference value (−8) as a comparison result, the controller 510 determines that a vessel is still present in the heating region. Accordingly, the controller 510 displays the presence of the vessel by turning on the vessel mark on the vessel selection button of the vessel selection region 722 (1012) and checks whether a heating start command is input (1020).

In one embodiment of the present disclosure, an absolute value of the third reference value may be set to be smaller than an absolute value of the second reference value. A sensing value obtained after the heating operation for the heating region is finished may have a slight error due to a high temperature. In consideration of the error, the absolute value of the third reference value used after the heating operation for the heating region is finished may be a value smaller than the absolute value of the second reference value (for example, a value corresponding to 80% the absolute value of the second reference value).

When the heating start command is not input as a checking result, the controller 510 turns off the vessel mark of the vessel selection button of the vessel selection region 722 and performs the second vessel sensing again (1014). Meanwhile, even when the vessel is completely removed from the heating region at the time point T5, the sensing value is shown as a value smaller than 100 due to residual heat of the heating region. After the time point T5, as the temperature of the heating region decreases, the sensing value gradually increases.

The controller 510 continuously performs the second vessel sensing even after the time point T5. A sensing value variation during a sensing time ST4 is a value obtained by subtracting 97 from 94, that is, −3. The controller 510 compares the sensing value variation (−3) of the sensing time ST4 with the predetermined third reference value (for example, −8). Since the sensing value variation (−3) is greater than or equal to the third reference value (−8) as a comparison result, the controller 510 determines that a vessel is not present in the heating region. When it is determined that the vessel is not present, the controller 510 turns off the vessel mark of the vessel selection button of the vessel selection region 722.

Then, the controller 510 continuously performs the second vessel sensing (1014), determines whether the vessel is present in the heating region (1016), and displays the presence of the vessel by turning on the vessel mark on the vessel selection button of the vessel selection region 722 (1018) when the vessel is present. When it is checked that the heating start command is input by the user again (1020), the controller 510 starts the heating operation for the heating region (1022) and stops a vessel sensing process.

Figure 21:
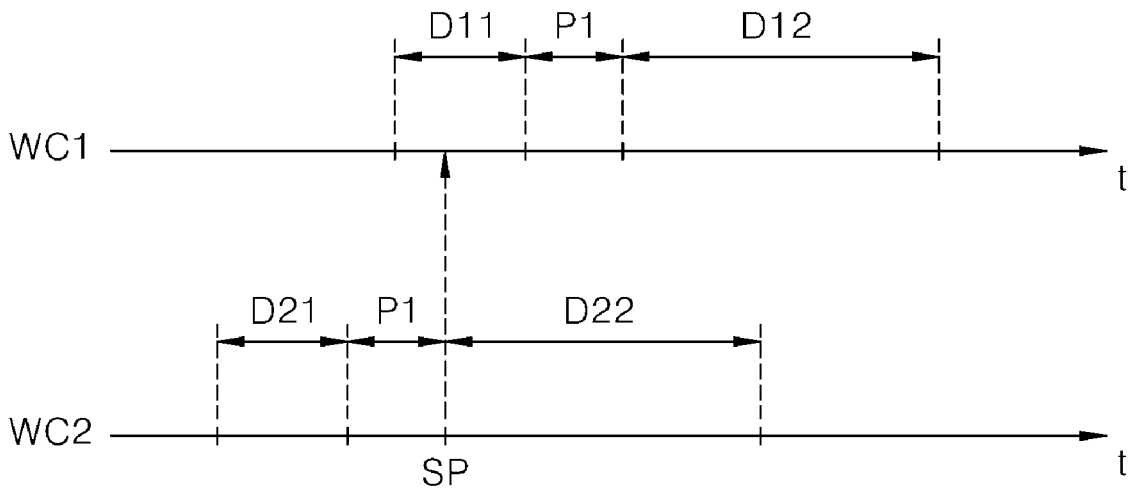
FIGS. 21 and 22 are views illustrating an effect of a length of a pause time set between first vessel sensing and second vessel sensing on the second vessel sensing.
Figure 22:
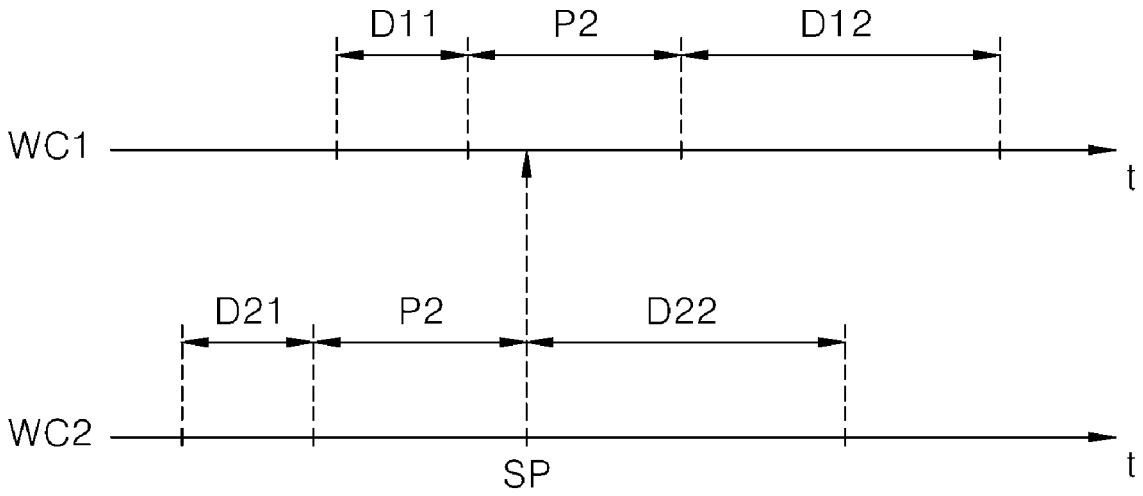

FIGS. 21 and 22 are views illustrating an effect of a length of a pause time set between the first vessel sensing and the second vessel sensing on the second vessel sensing. As described above, the controller 510 according to one embodiment of the present disclosure performs the second vessel sensing after a predetermined pause time passes from a point in time at which the first vessel sensing is finished. FIGS. 21 and 22 illustrate a first vessel sensing time D11, a second vessel sensing time D12, and each of pause times P1 and P2 for heating regions corresponding to two working coils adjacent to each other, that is, a first working coil WC1 and a second working coil WC2.

First, FIG. 21 illustrates vessel sensing timing for the heating regions corresponding to the working coils WC1 and WC2 when a first pause time P1 is set to be shorter than the first vessel sensing time D11. As shown in FIG. 21, the second vessel sensing time D22 is started after the pause time P1 passes after the first vessel sensing time D21 for the heating region corresponding to the second working coil WC2 is finished.

However, as shown in FIG. 21, when the first vessel sensing time D11 for the heating region corresponding to the first working coil WC1 is started during the pause time P1 for the heating region corresponding to the second working coil WC2, a starting point SP of the second vessel sensing for the heating region corresponding to the second working coil WC2 is included within the first vessel sensing time D11 for the heating region corresponding to the first working coil WC1.

As described above, when the second vessel sensing for the heating region corresponding to the second working coil WC2 is started within the first vessel sensing time D11 for the heating region corresponding to the first working coil WC1, currents applied to the first working coil WC1 or resonance of the first working coil WC1 influences the second working coil WC2 and the vessel detecting sensor disposed in a central region of the second working coil WC2. Accordingly, there is a high possibility that an error occurs in a sensing value obtained by the starting point SP of the second vessel sensing for the heating region corresponding to the second working coil WC2.

In order to reduce a possibility of a vessel sensing error occurring due to overlapping between the vessel sensing times of the adjacent working coils, the pause time P2 is set to be longer than the first vessel sensing times D11 and D21 in the present disclosure. For example, as shown in FIG. 22, when the pause time P2 is set to be adequately longer than the first vessel sensing times D11 and D21, the starting point SP of the second vessel sensing for the heating region corresponding to the second working coil WC2 is included within the pause time P2 after the first vessel sensing time D11 for the heating region corresponding to the first working coil WC1 is finished. Accordingly, since the sensing value obtained when the second vessel sensing for the heating region corresponding to the second working coil WC2 is started does not receive an influence by the first working coil WC1, a possibility of an error occurring in the second vessel sensing for the heating region corresponding to the second working coil WC2 is decreased.

However, since the vessel sensing is temporarily stopped during the pause time P2, it is not preferable to set the pause time P2 to be excessively long. Accordingly, the pause time P2 according to the present disclosure may be set as a value corresponding to 1.5 to 2 times the first vessel sensing times D11 and D21.

According to aspects of the present disclosure, noise generated when a vessel used in an induction heating device is sensed is reduced while simultaneously less power is used to sense whether the vessel is present. Also, according to the embodiments of the present disclosure, a vessel is precisely sensed by minimizing an influence caused by a change in a temperature of the vessel when the vessel is sensed.

Aspects of the present disclosure relate to providing an induction heating device and a vessel sensing method used in the induction heating device which are capable of reducing noise generated when a vessel used in the induction heating device is sensed while simultaneously less power is used to sense whether the vessel is present. Aspects of the present disclosure also relate to providing an induction heating device and a vessel sensing method used in the induction heating device which are capable of precisely sensing a vessel by minimizing an influence caused by a change in a temperature of the vessel during the vessel sensing.

Aspects of the present disclosure are not limited to the above-stated aspects and other unstated aspects and advantages of the present disclosure will be understood by the following description and will be more clearly understood by the embodiments of the present disclosure. Also, it will be easily understood that the aspects and advantages of the present disclosure can be implemented by components and a combination thereof shown in the claims.

An induction heating device according to the present disclosure determines whether a vessel is present in a heating region corresponding to a working coil using two sensing methods. In more detail, the induction heating device determines whether a vessel is present in the heating region by sequentially performing first vessel sensing based on a resonance current value of the working coil and second vessel sensing based on a sensing value obtained by a vessel sensor. It is possible to precisely sense a vessel by applying the two sensing methods as described above.

The induction heating device may sequentially perform the first vessel sensing and the second vessel sensing before a heating operation for the heating region is started or after the heating operation for the heating region is finished. That is, the induction heating device may not perform vessel sensing while the heating operation for the vessel is performed unlike a related art.

Particularly, in order to exclude an influence caused by a change in a temperature of a vessel when it is determined whether the vessel is present, the second vessel sensing using a vessel detecting sensor may be performed. During a second vessel sensing process, since it is determined whether a vessel is present on the basis of a sensing value variation which is a variation of a sensing value during a predetermined sensing time, vessel sensing may be precisely performed regardless of the temperature of the vessel.

According to an aspect of the present disclosure, there is provided an induction heating device including a working coil disposed corresponding to a heating region, a vessel detecting sensor disposed in a central region of the working coil, a current sensor configured to measure a resonance current value which is a level of a resonance current flowing through the working coil, and a controller configured to determine whether a vessel is present in the heating region by sequentially performing first vessel sensing based on the resonance current value and second vessel sensing based on a sensing value obtained by the vessel detecting sensor.

The controller may sequentially perform the first vessel sensing and the second vessel sensing before a heating operation for the heating region is started or after the heating operation for the heating region is finished.

The controller may determine that a vessel is present in the heating region when the resonance current value obtained while the working coil operates according to a predetermined sensing frequency is less than a predetermined first reference value, and the controller may determine that a vessel is not present in the heating region when the resonance current value obtained while the working coil operates according to the predetermined sensing frequency is greater than or equal to the predetermined first reference value.

The controller may determine whether a vessel is present in the heating region by comparing a sensing value variation, which is a variation of the sensing value during a predetermined sensing time, with a predetermined second reference value when the second vessel sensing is performed before the heating operation for the heating region is started.

The controller may determine that a vessel is present in the heating region when a sensing value variation which is a variation of the sensing value during a predetermined sensing time is greater than zero and the sensing value variation is greater than or equal to a predetermined second reference value, and the controller may determine that a vessel is not present in the heating region when the sensing value variation is greater than zero and the sensing value variation is less than the predetermined second reference value.

The controller may determine whether a vessel is present in the heating region by comparing a sensing value variation, which is a variation of the sensing value during a predetermined sensing time, with a predetermined third reference value when the second vessel sensing is performed after the heating operation for the heating region is finished.

The controller may determine that a vessel is present in the heating region when a sensing value variation which is a variation of the sensing value during a predetermined sensing time is less than zero and the sensing value variation is less than or equal to a predetermined third reference value, and the controller may determine that a vessel is not present in the heating region when the sensing value variation is smaller than zero and the sensing value variation is greater than the predetermined third reference value.

The controller may perform the first vessel sensing a predetermined number of times, and the controller may confirm whether a vessel is present in the heating region only when all results of performing the first vessel sensing for each number of times of sensing are equal.

The controller may perform the second vessel sensing after a predetermined idle time passes from a point in time at which the first vessel sensing is finished. The controller may obtain the sensing value whenever a predetermined sensing time passes.

According to another aspect of the present disclosure, there is provided a method of sensing a vessel in an induction heating device. The method includes checking whether a heating operation for a heating region is started or whether the heating operation for the heating region is finished, determining whether a vessel is present in the heating region by performing first vessel sensing based on a resonance current value obtained by a current sensor when it is seen that the heating operation is not started or the heating operation is finished, and determining whether a vessel is present in the heating region by performing second vessel sensing based on a sensing value obtained by a vessel detecting sensor when the first vessel sensing is finished.

The determining of whether a vessel is present in the heating region by performing the first vessel sensing may include determining that the vessel is present in the heating region when the resonance current value obtained when a working coil operates according to a predetermined sensing frequency is less than a predetermined first reference value and determining that a vessel is not present in the heating region when the resonance current value obtained when the working coil operates according to the predetermined sensing frequency is more than the predetermined first reference value.

The determining of whether a vessel is present in the heating region by performing the second vessel sensing may include determining whether a vessel is present in the heating region by comparing a sensing value variation, which is a variation of the sensing value during a predetermined sensing time, with a predetermined second reference value when the second vessel sensing is performed before the heating operation for the heating region is started.

The determining of whether a vessel is present in the heating region by performing the second vessel sensing may include determining that the vessel is present in the heating region when a sensing value variation which is a variation of the sensing value during a predetermined sensing time is greater than zero and the sensing value variation is greater than or equal to a predetermined second reference value and determining that the vessel is not present in the heating region when the sensing value variation is greater than zero and the sensing value variation is less than the predetermined second reference value.

The determining of whether a vessel is present in the heating region by performing the second vessel sensing includes determining whether a vessel is present in the heating region by comparing a sensing value variation, which is a variation of the sensing value during a predetermined sensing time, with a predetermined third reference value when the second vessel sensing is performed after the heating operation for the heating region is finished.

The method may include determining that a vessel is present in the heating region when a sensing value variation which is a variation of the sensing value during a predetermined sensing time is smaller than zero and the sensing value variation is less than or equal to a predetermined third reference value and determining that a vessel is not present in the heating region when the sensing value variation is smaller than zero and the sensing value variation is more than the predetermined third reference value.

The determining of whether a vessel is present in the heating region by performing the first vessel sensing may include performing the first vessel sensing a predetermined number of times and confirming whether the vessel is present in the heating region only when all results of performing the first vessel sensing for each number of times of sensing are equal.

The second vessel sensing may be performed after a predetermined pause time passes from a point in time at which the first vessel sensing is finished.

The sensing value may be obtained whenever a predetermined sensing time passes.

Although the embodiments of the present disclosure have been described with reference to the drawings, it is apparent that the present disclosure is not limited to the embodiments disclosed in the specification and the drawings and a variety of modifications may be made by one of ordinary skill in the art within the scope of the technical concept of the present disclosure. In addition, even though operations and effects according to the components of the present disclosure are not described with explicit disclosure, expectable effects of corresponding components should be acknowledged.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An induction heating device comprising:

a working coil corresponding to a heating region;

a sensing coil centrally positioned within the working coil;

a first sensor configured to measure a first resonance current value associated with the working coil;

a second sensor configured to generate a square wave by comparing a resonance signal generated by the sensing coil with a reference signal; and a controller configured to determine whether a vessel is present in the heating region by sequentially performing first vessel sensing based on the first resonance current value and second vessel sensing based on a sensing value, wherein the sensing value is defined as a number of waveforms of the square wave.

2. The induction heating device of claim 1, wherein the controller sequentially obtains the first resonance current value and the sensing value before a heating operation for the heating region is started or after the heating operation for the heating region is finished.

3. The induction heating device of claim 1, wherein the controller determines that the vessel is present in the heating region when the first resonance current value obtained while the working coil operates according to a particular sensing frequency is less than a first reference value, and wherein the controller determines that the vessel is not present in the heating region when the first resonance current value obtained while the working coil operates according to the particular sensing frequency is greater than or equal to the first reference value.

4. The induction heating device of claim 1, wherein the controller determines whether the vessel is present in the heating region based on comparing a variation in the sensing value, as measured during a prescribed sensing time before a heating operation for the heating region is started, with a second reference value.

5. The induction heating device of claim 1, wherein the controller determines that the vessel is present in the heating region when a variation of the sensing value during a particular sensing time is greater than zero and is greater than or equal to a second reference value, and wherein the controller determines that a vessel is not present in the heating region when the variation of the sensing value during the particular sensing time is greater than zero and is less than the second reference value.

6. The induction heating device of claim 1, wherein the controller determines whether the vessel is present in the heating region based on comparing a variation of the sensing value, as measured during a prescribed sensing time after a heating operation for the heating region is finished, with a third reference value.

7. The induction heating device of claim 1, wherein the controller determines that the vessel is present in the heating region when a variation of the sensing value during a prescribed sensing time is smaller than zero and is less than or equal to a third reference value, and wherein the controller determines that the vessel is not present in the heating region when the variation of the sensing value during the prescribed sensing time is smaller than zero and is more than the third reference value.

8. The induction heating device of claim 1, wherein the controller uses the first sensor to measure the first resonance current value of the working coil a prescribed number of times, and wherein the controller uses the second sensor to obtain the sensing value only when all of the first resonance current value measured by the first sensor the prescribed number of times indicate that the vessel is present in the heating region.

9. The induction heating device of claim 1, wherein the controller uses the second sensor to obtain the sensing value following a particular pause time after the controller finishes using the first sensor to measure the first resonance current value of the working coil.

10. The induction heating device of claim 1, wherein the controller uses the second sensor to obtain the sensing value after a particular sensing time passes after the controller previously used the second sensor to measure the sensing value.

11. A method comprising:

determining whether a heating operation for a heating region associated with a working coil of an induction heating device is started or whether the heating operation is finished;

measuring, before the heating operation has started or after the heating operation is finished, a first resonance current value associated with the working coil;

obtaining, after measuring the first resonance current value, a sensing value associated with a sensing coil provided radially within the working coil; and determining whether a vessel is present in the heating region by sequentially performing first vessel sensing based on the first resonance current value and second vessel sensing based on the sensing value, wherein the sensing value is defined as a number of waveforms of a square wave generated by comparing a resonance signal generated by the sensing coil with a reference signal.

12. The method of claim 11, wherein determining whether the vessel is present in the heating region includes:

determining that the vessel is present in the heating region when the first resonance current value obtained when the working coil operates according to a prescribed sensing frequency is less than a first reference value; and determining that the vessel is not present in the heating region when the first resonance current value obtained when the working coil operates according to the particular sensing frequency is equal to or more than the first reference value.

13. The method of claim 11, wherein determining whether the vessel is present in the heating region includes:

determining whether the vessel is present in the heating region based on comparing a variation in the sensing value, as measured during a particular sensing time before the heating operation for the heating region is started, with a second reference value.

14. The method of claim 13, wherein determining whether the vessel is present in the heating region includes:

determining that the vessel is present in the heating region when a variation of the sensing value during the particular sensing time is greater than zero and is greater than or equal to the second reference value; and determining that the vessel is not present in the heating region when the variation of the sensing value during the particular sensing time is greater than zero and is less than the second reference value.

15. The method of claim 11, wherein determining whether the vessel is present in the heating region includes:

determining whether the vessel is present in the heating region by comparing a variation of the sensing value, as measured during a particular sensing time after the heating operation for the heating region is finished, with a third reference value.

16. The method of claim 15, wherein determining whether the vessel is present in the heating region includes:

determining that the vessel is present in the heating region when the variation of the sensing value during the particular sensing time is smaller than zero and is less than or equal to the third reference value; and determining that the vessel is not present in the heating region when the variation of the sensing value during the particular sensing time is smaller than zero and is more than the third reference value.

17. The method of claim 11, wherein determining whether the vessel is present in the heating region includes:

measuring the first resonance current value associated with the working coil a plurality of times; and confirming whether the vessel is present in the heating region based on measuring the sensing value only when the first resonance current value associated with the working coil, for each of the plurality of times, indicates that the vessel is present in the heating region.

18. The method of claim 11, wherein the sensing value is measured a particular time period after the first resonance current value associated with the working coil is measured.

19. The method of claim 11, wherein the sensing value is measured after a particular sensing time passes since the sensing value associated with the sensing coil was previously measured.

20. The method of claim 11, further comprising displaying a graphical indication of whether the vessel is present in the heating region, as determined based on evaluating the first resonance current value and the sensing value.

* * * * *